US011806596B2

(12) United States Patent
Plante et al.

(10) Patent No.: US 11,806,596 B2
(45) Date of Patent: Nov. 7, 2023

(54) HOCKEY STICK WITH VARIABLE GEOMETRY SHAFT AND PADDLE

(71) Applicant: Bauer Hockey Ltd., Blainville (CA)

(72) Inventors: Dominique Plante, Pointe-Claire (CA); Mathieu Poitras, St-Jerome (CA); Edouard Rouzier, Montreal (CA)

(73) Assignee: Bauer Hockey, LLC, Exeter, NH (US)

( * ) Notice: Subject to any disclaimer, the term of this patent is extended or adjusted under 35 U.S.C. 154(b) by 0 days.

(21) Appl. No.: 17/100,336

(22) Filed: Nov. 20, 2020

(65) Prior Publication Data

US 2022/0161109 A1 May 26, 2022

(51) Int. Cl.

| | |
|---|---|
| ***A63B 60/12*** | (2015.01) |
| ***A63B 59/70*** | (2015.01) |
| ***A63B 102/24*** | (2015.01) |
| ***A63B 60/20*** | (2015.01) |

(52) U.S. Cl.

CPC ..... *A63B 60/12* (2015.10); *A63B 59/70* (2015.10); *A63B 60/20* (2015.10); *A63B 2102/24* (2015.10)

(58) Field of Classification Search

CPC ..... A63B 59/14; A63B 59/00; A63B 59/58
See application file for complete search history.

(56) References Cited

U.S. PATENT DOCUMENTS

| | | | | |
|---|---|---|---|---|
| 1,013,734 | A | | 1/1912 | Boyd |
| 1,023,223 | A | | 4/1912 | Parsons |
| 1,031,508 | A | | 7/1912 | Ashworth |
| 1,036,346 | A | | 8/1912 | Schmittberger |
| 3,940,134 | A | | 2/1976 | Bieganowski |
| D241,758 | S | | 10/1976 | Matilainen |
| D263,329 | S | | 3/1982 | Clayton |
| 4,340,224 | A | | 7/1982 | Staats |
| 4,544,157 | A | | 10/1985 | Curtis |
| D344,115 | S | | 2/1994 | Goyette |
| 5,456,463 | A | | 10/1995 | Dolan et al. |
| 5,588,921 | A | | 12/1996 | Parsick |
| D380,027 | S | | 6/1997 | Ferguson |
| 5,636,836 | A | * | 6/1997 | Carroll ..... A63B 60/00 473/561 |
| 5,729,864 | A | | 3/1998 | Lie et al. |
| 5,839,977 | A | | 11/1998 | Maurer et al. |

(Continued)

FOREIGN PATENT DOCUMENTS

| | | | |
|---|---|---|---|
| CA | 2106178 | A1 | 3/1995 |
| CA | 2145010 | A1 | 9/1996 |

(Continued)

OTHER PUBLICATIONS

"Bauer junior SH1000 street hockey goalie stick"; dickssportinggoods.com; retrieved Jun. 27, 2022; published date unkown, prior to the filing date of the present Application; URL: <https://www.dickssportinggoods.com/p/bauer-junior-sh1000-%20street-hockey-goalie-stick-19bauubrsh1000glsshk/19bauubrsh1000glsshk>.

(Continued)

*Primary Examiner* — Eugene L Kim
*Assistant Examiner* — Christopher Glenn
(74) *Attorney, Agent, or Firm* — Banner & Witcoff, Ltd.

(57) ABSTRACT

Aspects of this disclosure relate to improved ergonomic hockey sticks and hockey goalie sticks having shafts and paddles with variable geometric shapes and facets for enhanced gripping ability, and methods for the production thereof.

10 Claims, 27 Drawing Sheets

(56) References Cited

U.S. PATENT DOCUMENTS

| | | | |
|---|---|---|---|
| D406,625 | S | 3/1999 | Hutzenlaub |
| D431,621 | S | 10/2000 | Pagotto et al. |
| D444,520 | S | 7/2001 | O'Malley |
| 6,500,079 | B1 | 12/2002 | Tucker, Sr. |
| 6,533,985 | B1 | 3/2003 | Smith |
| D475,425 | S | 6/2003 | Larsen |
| D492,375 | S | 6/2004 | Berghash et al. |
| 6,752,731 | B1 | 6/2004 | Kramer |
| D496,703 | S | 9/2004 | Gans |
| 7,097,577 | B2 | 8/2006 | Goldsmith et al. |
| 7,201,678 | B2 | 4/2007 | Filice et al. |
| D544,932 | S | 6/2007 | Scott |
| 7,282,001 | B2 | 10/2007 | Ponzini |
| 7,285,063 | B2 | 10/2007 | Lussier et al. |
| D581,474 | S | 11/2008 | Dickie et al. |
| D581,475 | S | 11/2008 | Dickie et al. |
| 7,462,118 | B2 | 12/2008 | Tucker, Sr. et al. |
| D589,099 | S | 3/2009 | Purnell |
| D589,101 | S | 3/2009 | Dickie et al. |
| D594,920 | S | 6/2009 | Drouin et al. |
| 7,621,829 | B2 | 11/2009 | Barkume |
| 7,744,497 | B2 | 6/2010 | Phelan, Jr. |
| 7,749,112 | B2 | 7/2010 | Hayden et al. |
| 7,789,778 | B2 | 9/2010 | Goldsmith et al. |
| 7,850,553 | B2 | 12/2010 | Goldsmith et al. |
| 7,931,549 | B2 | 4/2011 | Pearson et al. |
| 8,047,935 | B2 | 11/2011 | Sugaya |
| 8,052,551 | B2 | 11/2011 | Blotteaux et al. |
| 8,182,376 | B2 | 5/2012 | Kotula |
| 8,251,844 | B2 | 8/2012 | Cross et al. |
| D684,225 | S | 6/2013 | LaCroix |
| 8,708,846 | B2 | 4/2014 | Hisle, Jr. et al. |
| D735,282 | S | 7/2015 | Burns et al. |
| 9,101,804 | B2 | 8/2015 | Brenner |
| D752,166 | S | 3/2016 | Kozac |
| 9,346,528 | B2 | 5/2016 | Webb |
| 9,421,441 | B2 | 8/2016 | Cross |
| 9,463,365 | B2 | 10/2016 | Brenner |
| D770,582 | S | 11/2016 | Gosselin |
| D774,612 | S | 12/2016 | Dingman |
| D779,607 | S | 2/2017 | Murphy, Jr. |
| 9,586,112 | B2 | 3/2017 | Sola et al. |
| 9,687,706 | B1 | 6/2017 | Cormier |
| 9,833,674 | B2 | 12/2017 | Cross |
| 9,878,227 | B2 | 1/2018 | Kozac |
| D836,173 | S | 12/2018 | Plante et al. |
| D836,735 | S | 12/2018 | Plante et al. |
| D836,739 | S | 12/2018 | Plante et al. |
| D843,530 | S | 3/2019 | Plante et al. |
| 10,232,238 | B2 | 3/2019 | Plante et al. |
| D844,726 | S | 4/2019 | Rouzier |
| D845,410 | S | 4/2019 | Rouzier |
| D845,416 | S | 4/2019 | Rouzier |
| 10,449,430 | B2 | 10/2019 | Plante et al. |
| 10,456,640 | B2 | 10/2019 | Rouzier et al. |
| 10,596,431 | B2 | 3/2020 | Rouzier |
| D903,021 | S | 11/2020 | Plante et al. |
| D903,022 | S | 11/2020 | Plante et al. |
| 2004/0084815 | A1 | 5/2004 | Blotteaux |
| 2005/0130773 | A1 | 6/2005 | Hayden et al. |
| 2005/0187045 | A1 | 8/2005 | Berghash |
| 2006/0025246 | A1 | 2/2006 | Forney et al. |
| 2006/0135330 | A1 | 6/2006 | Clark et al. |
| 2007/0129186 | A1 | 6/2007 | Appleton |
| 2007/0155548 | A1 | 7/2007 | Goldsmith et al. |
| 2008/0026882 | A1 | 1/2008 | Main |
| 2008/0026885 | A1 | 1/2008 | Lamson et al. |
| 2009/0124437 | A1 | 5/2009 | Grodin |
| 2010/0029417 | A1* | 2/2010 | Sugaya ..... A63B 60/06 473/561 |
| 2010/0323830 | A1* | 12/2010 | Blotteaux ..... A63B 49/14 264/279 |
| 2013/0045822 | A1 | 2/2013 | Stefan |
| 2014/0100064 | A1* | 4/2014 | Cross ..... A63B 60/42 473/560 |
| 2015/0126310 | A1* | 5/2015 | Brenner ..... A63B 60/06 473/560 |
| 2016/0206938 | A1 | 7/2016 | Lacey et al. |
| 2016/0236050 | A1 | 8/2016 | Allard et al. |
| 2017/0239541 | A1* | 8/2017 | Eastman ..... A63B 53/14 |
| 2017/0296892 | A1* | 10/2017 | Bergeron ..... A63B 59/70 |
| 2018/0085647 | A1 | 3/2018 | Caron Kardos et al. |
| 2018/0311551 | A1* | 11/2018 | Oman ..... A63B 59/70 |
| 2019/0184249 | A1 | 6/2019 | Rouzier et al. |
| 2020/0222771 | A1 | 7/2020 | Plante et al. |
| 2020/0269124 | A1* | 8/2020 | St. Vincent ..... A63B 60/06 |
| 2022/0161109 | A1 | 5/2022 | Plante et al. |

FOREIGN PATENT DOCUMENTS

| | | | |
|---|---|---|---|
| CA | 86452 | | 4/1999 |
| CA | 87944 | | 10/1999 |
| CA | 174930 | | 4/2018 |
| CA | 174931 | | 4/2018 |
| CA | 2966440 | A1 | 11/2018 |
| CA | 2967783 | A1 | 11/2018 |
| CH | 6589092 | A5 | 9/1998 |
| CN | 302753704 | S | 3/2014 |
| EM | 001842899-0001 | | 4/2011 |
| EM | 003621697-0001 | | 1/2017 |
| EM | 003621697-0002 | | 1/2017 |
| EM | 003667849-0001 | | 2/2017 |
| EP | 0790882 | A1 | 8/1997 |
| EP | 1082164 | A1 | 3/2001 |
| GB | 2496583 | A | 5/2013 |
| WO | 9815389 | A2 | 4/1998 |
| WO | 200404067100 | A2 | 8/2004 |
| WO | 06074566 | A1 | 7/2006 |
| WO | 2016055962 | A1 | 4/2016 |
| WO | 2019156406 | | 8/2019 |

OTHER PUBLICATIONS

"Goalie hockey stick google search"; google.com; retrieved Jun. 27, 2022; published date unkown, prior to the filing date of the present Application; URL: <https://www.google.com/search?q=goalie+hockey+stick>.

"Bauer goalie hockey stick google search"; google.com; retrieved Jun. 27, 2022; published date unkown, prior to the filing date of the present Application; URL: <https://www.google.com/search?q=bauer+goalie+hockey+stick>.

Jan. 16, 2023—(CA) Examiner's Report—App. No. 3,139,488.

* cited by examiner

HOCKEY STICK WITH VARIABLE GEOMETRY SHAFT AND PADDLE

FIELD

This disclosure relates generally to hockey stick components with variable geometries including faceted structures and uniquely ergonomic structures. More particularly, aspects of this disclosure relate to hockey stick shaft structures and goalie stick shaft and paddle structures.

BACKGROUND

The players of the game of hockey use hockey sticks and goalie sticks to pass, shoot, and score goals, or to prevent the scoring of goals. Hockey sticks with ergonomic features allow hockey plays to better manipulate hockey sticks to improve puck-handling abilities, passing abilities, shooting abilities, and blocking abilities in the case of goalie sticks. Aspects of this disclosure relate to improved ergonomic hockey sticks and hockey goalie sticks having shafts and paddles with variable shapes and facets for enhanced gripping ability, and methods for the production thereof.

SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Aspects of the disclosure are directed to ergonomic hockey sticks. In some examples, a hockey stick may include a blade and a shaft attached to the blade. In certain examples, the shaft may further include a first gripping structure positioned on a palm-side of the shaft, and the first gripping structure and the shaft may form a five-sided polygonal cross-section. In other examples, the cross-section formed by the first gripping structure and the shaft may be substantially pentagonal-shaped or may have five distinct sides. In still other examples, the hockey stick first gripping structure may extend longitudinally from a midpoint of the shaft towards a top of the shaft.

In some examples, a goalie stick paddle may be configured between the shaft and the blade. In certain examples, the first gripping structure may extend longitudinally from the shaft into the paddle. In yet other examples, the paddle may further include a second gripping structure that is positioned on the paddle and opposite, or on the opposite side, of the first gripping structure. In another example, the second gripping structure may be at least one finger or thumb support. In still other examples, the formed blade and shaft may be overmolded with the first gripping structure. In another example, the blade, the shaft, and the first gripping structure may be formed together in a first mold as a unitary structure. In still another example, the first gripping structure may be attached to the shaft with an adhesive after formation of the hockey stick.

Aspects of the present disclosure are also directed to hockey goalie sticks with ergonomic features on the shaft and paddle for better gripping. In some examples, a hockey goalie stick may include a shaft, a paddle attached to the shaft, a blade attached to the paddle, and a first gripping structure. In some examples, the first gripping structure may be positioned on a palm-side of the shaft and may extend into the paddle. In certain examples, the first gripping structure and the shaft may form a five-sided polygonal cross-section. In other examples, the cross-section formed by the first gripping structure and the shaft may be substantially pentagonal-shaped. In still other examples, the first gripping structure may extend longitudinally from a midpoint of the shaft towards a top of the shaft.

In certain examples, the paddle may further include a second gripping structure positioned on the back side of the paddle and opposite the first gripping structure. In other examples, the second gripping structure may be at least one finger or thumb support. In certain examples, the second gripping structure may be a plurality of finger or thumb supports. In yet other examples, the final formed blade, shaft, and paddle may be overmolded with the first gripping structure and/or the second gripping structure. In still other examples, the blade, the shaft, the paddle, and the first gripping structure and/or the second gripping structure may be formed together in a first mold. In one example, the first gripping structure may be attached to the shaft and the paddle with an adhesive.

Certain aspects of the present disclosure are directed to improved hockey goalie stick that may include a shaft, a paddle attached to the shaft, a blade attached to the paddle, and a first gripping structure. In some examples, the first gripping structure may be positioned on a palm-side of the shaft and may extend into the paddle. In other examples, the first gripping structure and the shaft may form a five-sided polygonal cross-section. In another example, a second gripping structure may be positioned on an upper portion of a back of the paddle. In other examples, the second gripping structure may be at least one finger or thumb support. In another example, the second gripping structure may be a plurality of finger or thumb supports.

BRIEF DESCRIPTION OF THE DRAWINGS

The present disclosure is illustrated by way of example and not limited in the accompanying figures in which like reference numerals indicate similar elements and in which.

Further, it is to be understood that the drawings may represent the scale of different component of one single embodiment; however, the disclosed embodiments are not limited to that particular scale.

DETAILED DESCRIPTION

In the following description of various example structures, reference is made to the accompanying drawings, which form a part hereof, and in which are shown by way of illustration various embodiments in which aspects of the disclosure may be practiced. Additionally, it is to be understood that other specific arrangements of parts and structures may be utilized, and structural and functional modifications may be made without departing from the scope of the present disclosures. Also, while the terms "top" and "bottom" and the like may be used in this specification to describe various example features and elements, these terms are used herein as a matter of convenience, e.g., based on the example orientations shown in the figures and/or the orientations in typical use. Nothing in this specification should be construed as requiring a specific three-dimensional or spatial orientation of structures in order to fall within the scope of this invention. The terms "hockey stick" and "hockey goalie stick" are understood to be used interchangeably. Features disclosed herein may be used in conjunction with both conventional hockey player sticks and hockey goalie sticks.

Aspects of this disclosure relate to ergonomic hockey sticks and hockey goalie sticks having shafts and paddles with variable shapes and facets for enhanced gripping ability, and methods for the production thereof.

In general, hockey stick shafts, and in particular, goalie stick shafts are typically straight with minimal ergonomic design for a player's hand for your hand. The stick shaft does not follow the shape of the hand. As shown in the prior art, see FIG. 1A, the rectangular shaft cross-section of hockey stick 99 does not follow or conform the shape of a player's hand. As such, the negative space between the hand and the stick shaft results in a lack of control and comfort that also causes stress and fatigue of the hand. As described herein, a faceted or geometrically variable shaft may improve the players grip on the goalie stick or hockey stick resulting in improved control and improved comfort. The improved ergonomics of the hockey stick shaft(s) disclosed herein ultimately reduce player hand fatigue and reduce stress on the player's hand.

Figure 1B:
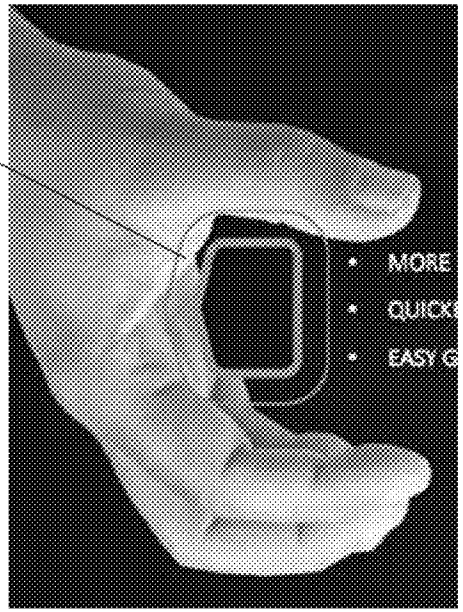
FIG. 1B PRIOR ART
FIGS. 1A and 1B depict a respective prior art hockey stick shaft and a novel hockey stick shaft with a variable geometry/faceted shaft, according to one or more aspects described herein.
Figure 1A:
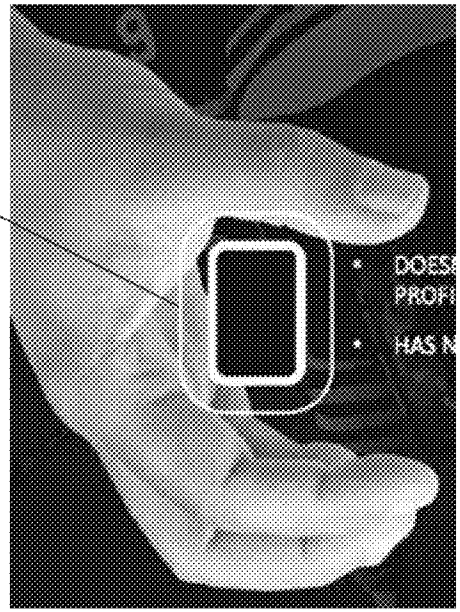

As depicted in FIG. 1B, a hockey stick shaft is disclosed herein, for example, with a pentagonal geometry to the shaft in the zone where a hockey player grips the stick. The pentagonal shaped cross-section provides an improved ergonomic fit for the hand by following the shape of the player's hand when holding the hockey stick. Such a variation in the shaft geometry improves player grip improving overall dexterity to include rotational control of the hockey stick. For example, the pentagonal shaped cross-section of the shaft 102 provides improved surfaces for placement of the player's palm, fingers, and thumb that allow more control higher on the hockey stick shaft when playing the puck. The geometric shape of the shaft may also decrease energy loss by filling the players hand. Further, players lose their grip on the stick during rapid hand movements due to the speed at which a hockey game is played. The geometric configuration of the hockey stick shaft disclosed herein improve grip control and provided goaltenders with increased stick control.

FIG. 1B depicts a cross-sectional view a shaft 102 of a hockey stick 100, according to one or more aspects described herein. In particular, hockey stick 100 may be utilized as a goalie stick. However, the various disclosures described herein in relation to hockey stick 100 may be utilized in other stick implementations (e.g. non-goalie stick types), without departing from the scope of these disclosures. As depicted, hockey stick 100 has a shaft 102 cross-sectional area that is a generally pentagonal geometry and is intended to be gripped with a player's hand with the two facets of the pentagonal cross-section contacting the palm of the player's hand as depicted in FIG. 1B. However, it is to be understood that the same disclosures described in relation to hockey stick 100 may be utilized in a stick with an opposite curved blade and may be configured to be gripped with a user's opposite-hand, without departing from the scope of these disclosures. In other words, the hockey sticks disclosed herein may be configured for both left-handed and/or right-handed players. It is also contemplated that the hockey stick shaft 102 cross-section may be a mirror image and have the same geometric figures on both sides of the shaft 102. For example, the shaft cross-section may be substantially hexagonal in shape.

Figure 2A:
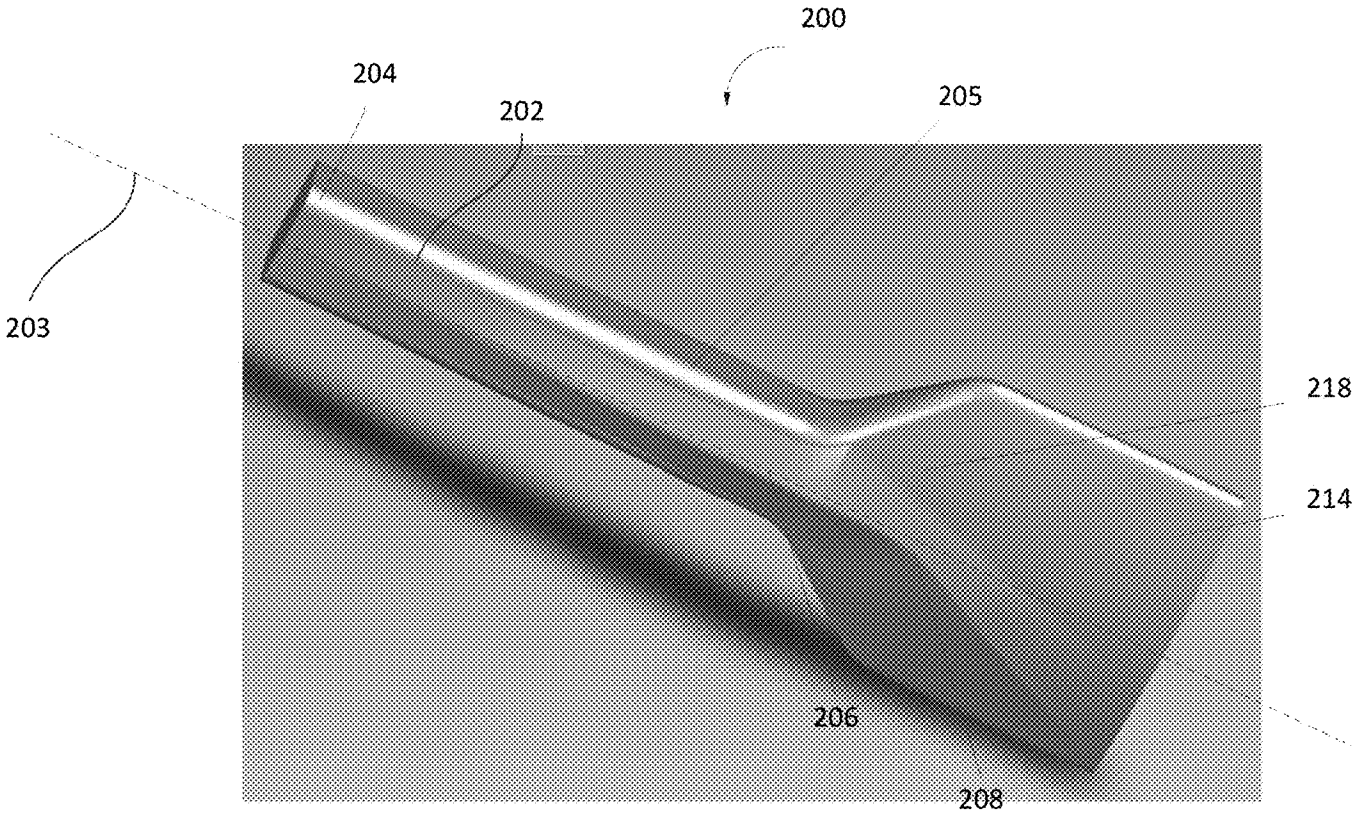
FIGS. 2A and 2B depict a respective front side and back side of a hockey goalie stick, according to one or more aspects described herein.
Figure 2B:
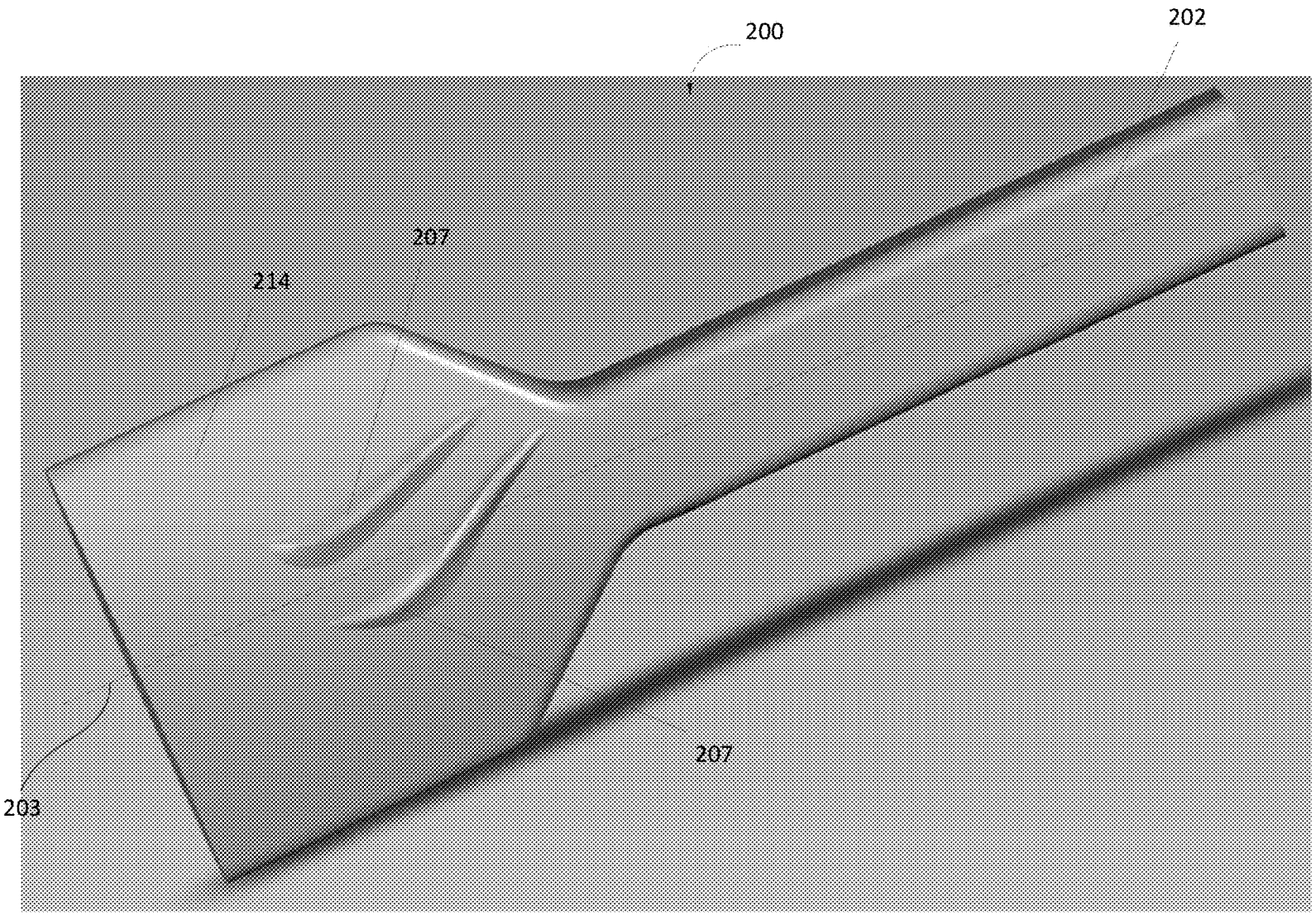

FIGS. 2A and 2B depict a respective front (side) and back (side) of a hockey stick 200, according to one or more aspects described herein. Hockey stick 200, which may otherwise be referred to as a hockey stick apparatus 200 may include a shaft 202 that has a proximal end 204 and a distal end 206. The shaft may include a rib or gripping structure 205 that may extend longitudinally from the shaft 202 to the proximal end or shoulder 218 of the paddle 214. The gripping structure 205 may be configured on the side of the shaft 202 and bend distally from a longitudinal axis 203 defined along the shaft and the paddle and represented by the segmented line in FIG. 2A. The gripping structure 205 may bend at a point 208 below the shoulder 218 and below or distally from the point at which the shaft 202 connects to the paddle 214. The gripping structure 205 may bend at least 5, 10, 15, 20, 25, 30, 35, 40, or 45 degrees from an imaginary line defined by the longitudinal axis of the shaft and paddle. The portion of the gripping structure 205 that bends may form an angle between the straight portion of the gripping structure configured on the shaft of about 0-5 degrees, 5-10 degrees, 5-15 degrees 10-15 degrees, 10-20 degrees, 10-30 degrees, 10-45 degrees, 15-35 degrees, 25-45 degrees, or 35-35 degrees. The unique contour of the gripping structure 205 is ergonomically optimized to fit the palm of the hand and/or to provide a finger gripping structure to improve handling and control of the stick.

As shown in FIG. 2B, a second gripping structure 207 may be configured on the opposite side of the paddle 214. The gripping structure may be a finger or thumb grip 207. The hockey stick 200 may be configured with at least one, at least two, approximately two, or a plurality of second gripping structures 207. The unique contour of the second gripping structure 207 is ergonomically optimized to provide the player a finger or thumb gripping structure to improve handling and control of the stick. The second gripping 207 structure may include a wavy, generally j-shaped or generally s-shaped geometry.

Figure 3A:
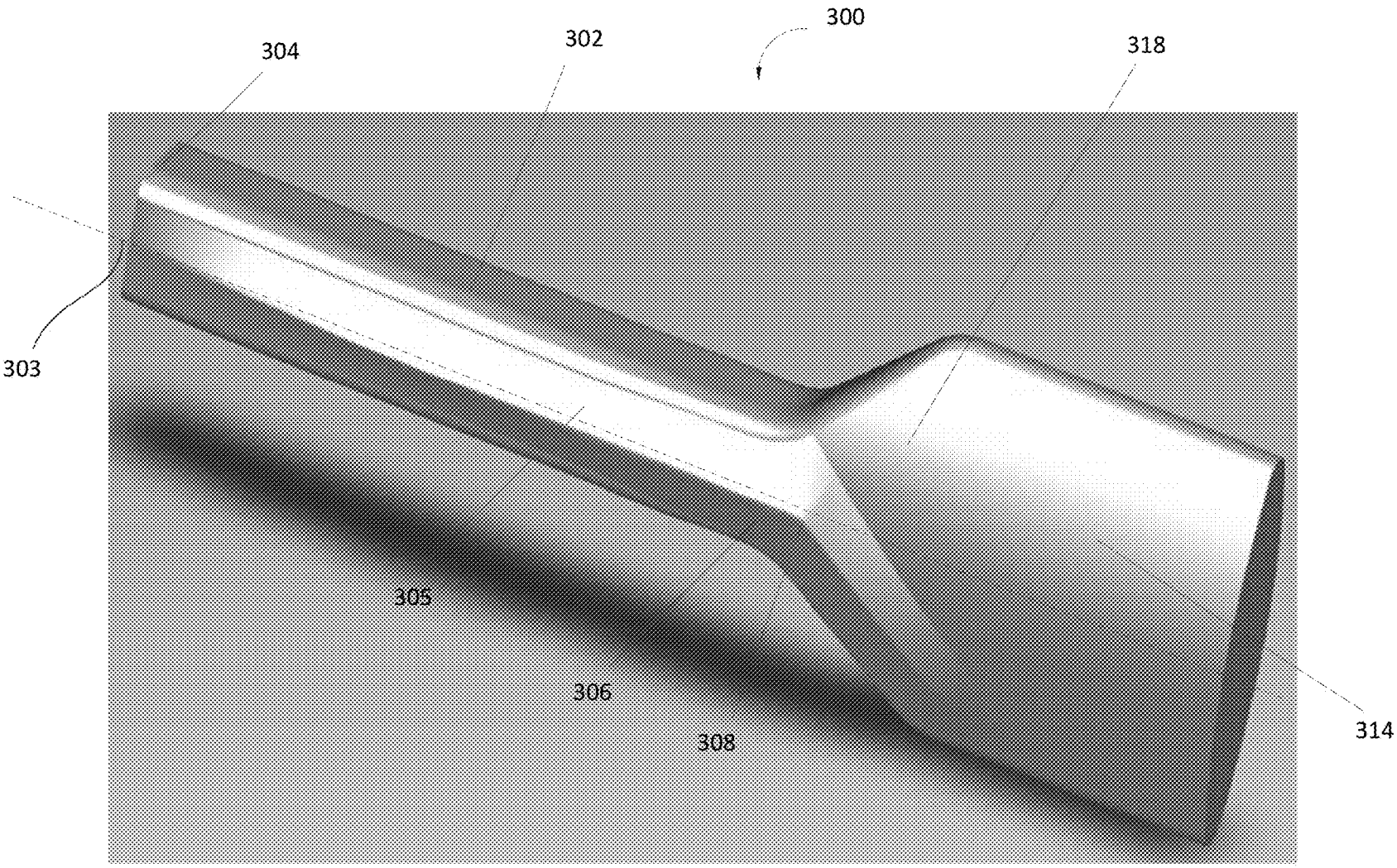
FIGS. 3A and 3B depict a respective front side and back side of another hockey goalie stick, according to one or more aspects described herein.
Figure 3B:
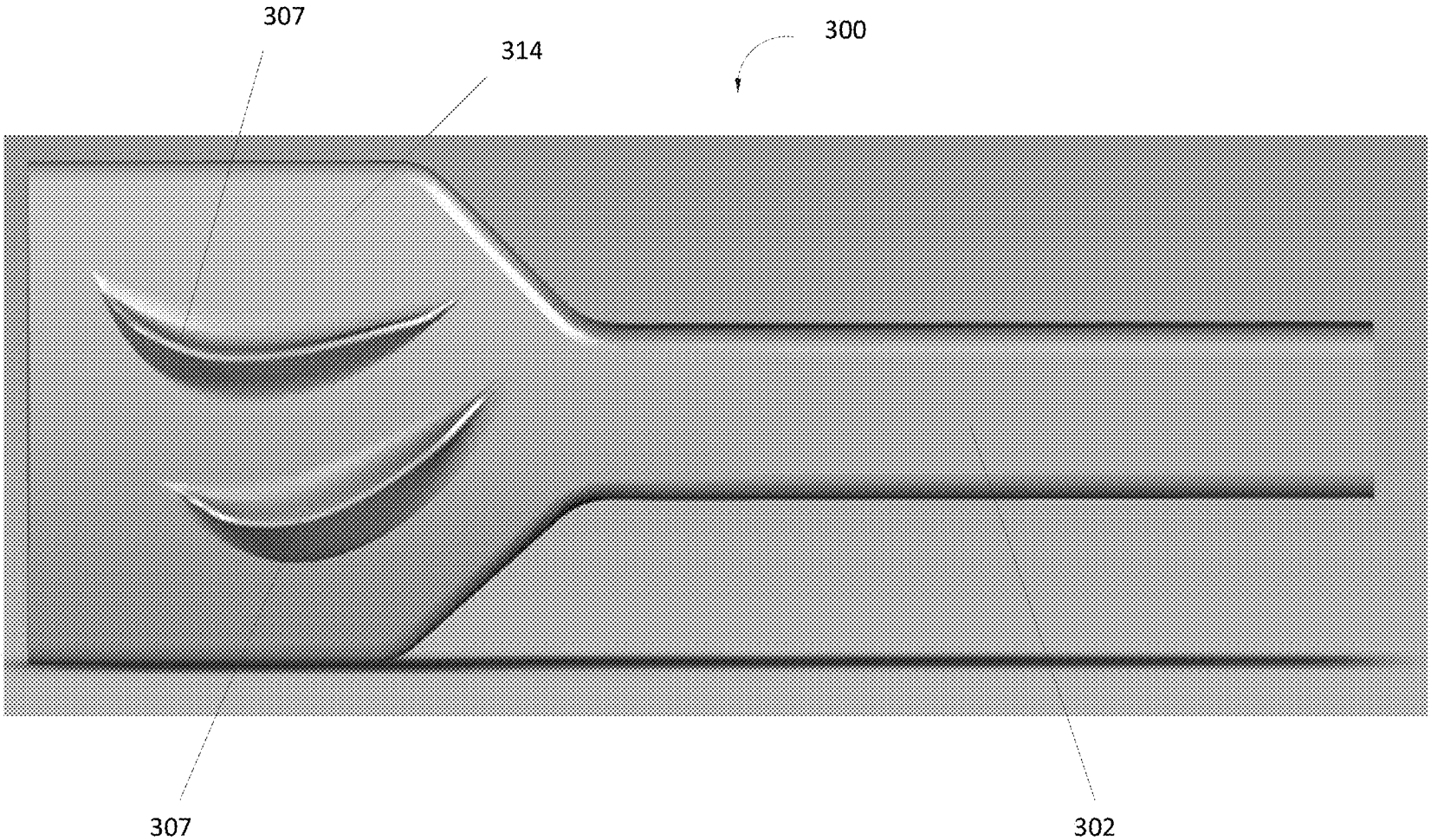

FIGS. 3A and 3B depict a respective front view and rear view of another hockey goalie stick, according to one or more aspects described herein. Hockey stick 300 may include a shaft 302 that has a proximal end 304 and a distal end 306. The shaft may include a rib or gripping structure 305 that may extend longitudinally from the shaft 302 to the proximal end or shoulder 318 of the paddle 314. As shown in FIG. 3B, a second gripping structure 307 may be configured on the opposite side of the paddle 314. The gripping structure may be a finger or thumb grip 307. The gripping structure 305 may be configured on the side of the shaft 302 and bend distally from a longitudinal axis 303 along the shaft and the paddle. The gripping structure 305 may bend at a point 308 where the shaft 302 connects to the paddle 314. The gripping structure 305 may bend at least 5, 10, 15, 20, 25, 30, 35, 40, or 45 degrees from an imaginary line defined by the longitudinal axis of the shaft and paddle. The portion of the gripping structure 305 that bends may form an angle between the straight portion of the gripping structure configured on the shaft of about 0-5 degrees, 5-10 degrees, 5-15 degrees 10-15 degrees, 10-20 degrees, 10-30 degrees, 10-45 degrees, 15-35 degrees, 25-45 degrees, or 35-45 degrees. The unique contour of the gripping structure 305 is ergonomically optimized to fit the palm of the hand and/or to provide a finger gripping structure to improve handling and control of the stick.

As shown in FIG. 3B, a second gripping structure 307 may be configured on the opposite side of the paddle 314. The gripping structure may be a finger or thumb grip 307. The hockey stick 300 may be configured with at least one, at least two, approximately two, or a plurality of second gripping structures 307. The unique contour of the second gripping structure 307 is ergonomically optimized to provide the player a finger or thumb gripping structure to improve handling and control of the stick. The second gripping structure 307 may include a wavy, generally j-shaped or generally s-shaped geometry.

Figure 4A:
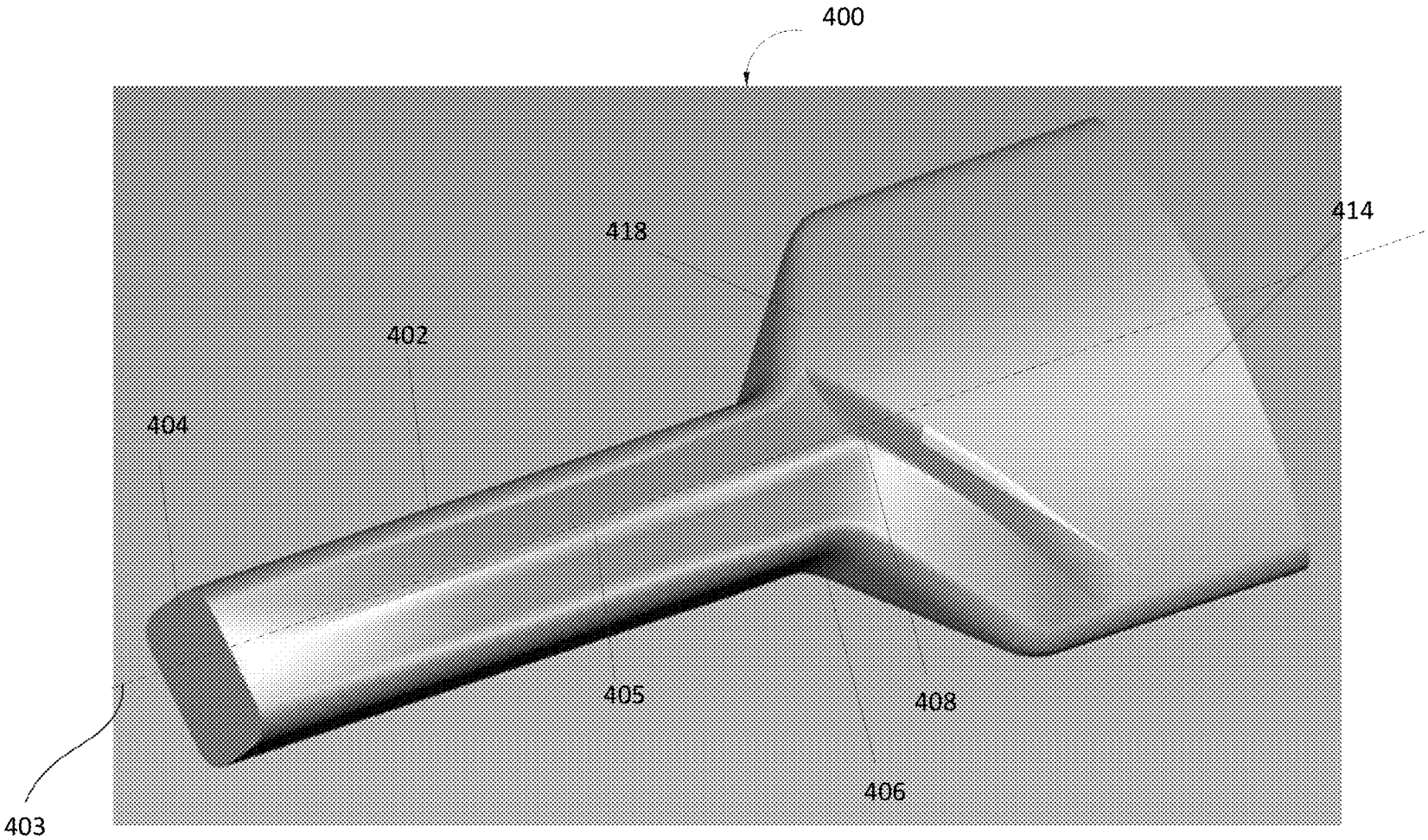
FIGS. 4A and 4B depict a respective front side and back side of another hockey goalie stick, according to one or more aspects described herein.
Figure 4B:
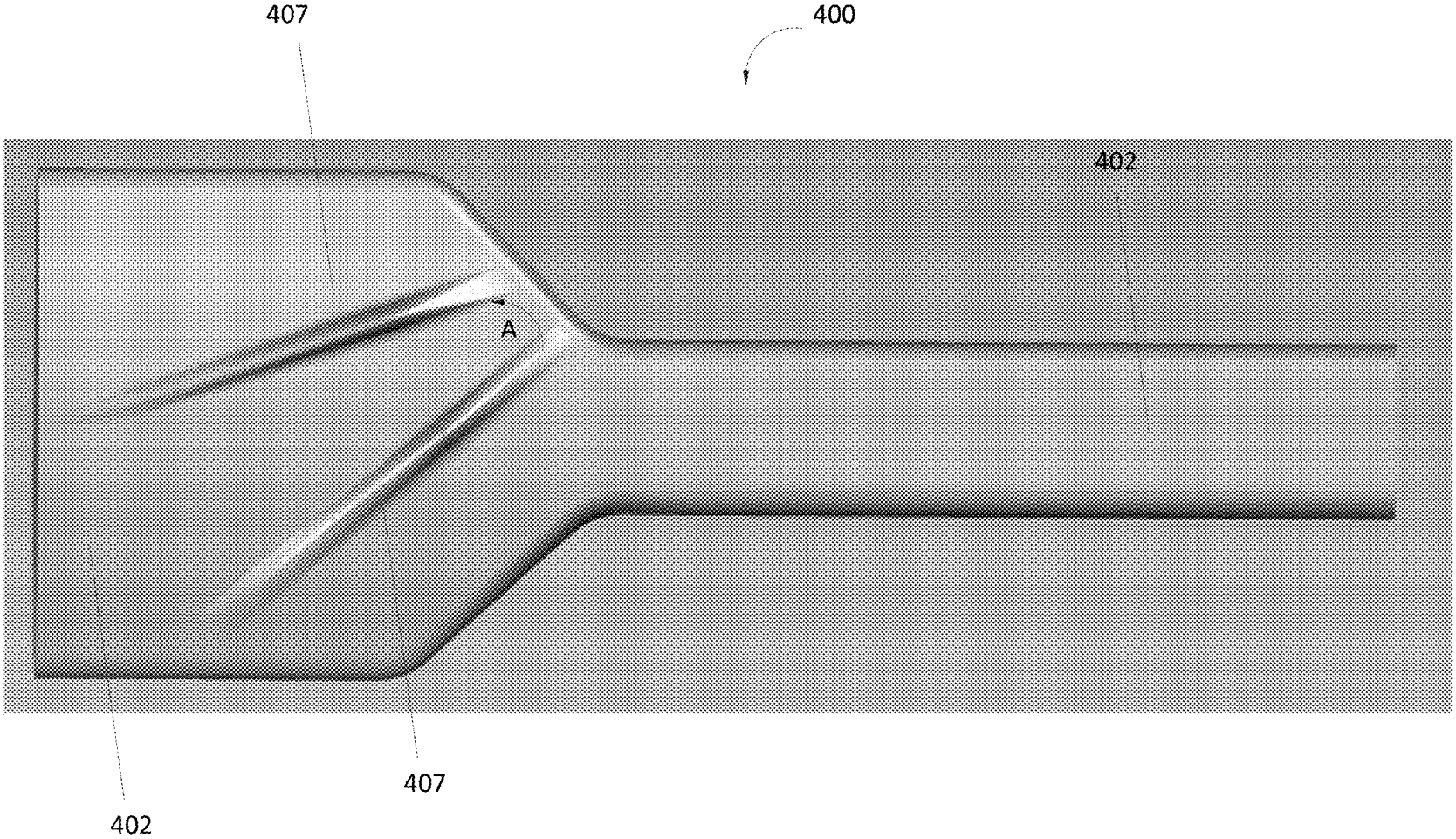

FIGS. 4A and 4B depict a respective front and back of another hockey goalie stick, according to one or more aspects described herein. Hockey stick 400 may include a shaft 402 that has a proximal end 404 and a distal end 406. The shaft may include a rib or gripping structure 405 that may extend longitudinally from the shaft 402 to the proximal end or shoulder 418 of the paddle 414. As shown in FIG. 4B, a second gripping structure 407 may be configured on the opposite side of the paddle 414. The gripping structure may be a finger or thumb grip 407. The gripping structure 405 may be configured on the side of the shaft 402 and bend distally from a longitudinal axis 403 along the shaft and the paddle. The gripping structure 405 may bend at a point 408 just below or distal from the area where shaft 402 connects to the paddle 414. The gripping structure 405 may bend at least 5, 10, 15, 20, 25, 30, 35, 40, or 45 degrees from an imaginary line defined by the longitudinal axis of the shaft and paddle. The portion of the gripping structure 405 that bends may form an angle between the straight portion of the gripping structure configured on the shaft of about 0-5 degrees, 5-10 degrees, 5-15 degrees 10-15 degrees, 10-20 degrees, 10-30 degrees, 10-45 degrees, 15-35 degrees, 25-45 degrees, or 35-45 degrees. The unique contour of the gripping structure 405 is ergonomically optimized to fit the palm of the hand and/or to provide a finger gripping structure to improve handling and control of the stick.

As shown in FIG. 4B, a second gripping structure 407 may be configured on the opposite side of the paddle 414. The gripping structure may be a finger or thumb grip 407. The hockey stick 400 may be configured with at least one, at least two, approximately two, or a plurality of second gripping structures 407. The unique contour of the second gripping structure 407 is ergonomically optimized to provide the player a finger or thumb gripping structure to improve handling and control of the stick. The second gripping 407 structure may generally be a linear or straight structure. An angle A may be formed between second gripping structures 407. Angle A may be about 0, 5, 10, 15, 20, 25, 30, 35, 40, or 45 degrees, or about 0-5 degrees, 5-10 degrees, 5-15 degrees 10-15 degrees, 10-20 degrees, 10-30 degrees, 10-45 degrees, 15-35 degrees, 25-45 degrees, or 35-45 degrees. Second gripping structure 407 may include a width and a length. For example, the width may be approximately 5 mm and the length may be 80 mm. In other examples, the width may be at least 5 mm and the length may be at least 80 mm. In yet other examples, the width may be at least, greater than, less than, equal to, or any number in between about 1 mm, 2 mm, 3 mm, 4 mm, 5 mm, 6 mm, 7 mm, 8 mm, 9 mm, and 10 mm. In still other examples, the length may be at least, greater than, less than, equal to, or any number in between about 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, 105 mm, 110 mm, 115 mm, 120 mm, 120 mm, 125 mm, 130 mm, 135 mm, 140 mm, 145 mm, and 150 mm.

Figure 5A:
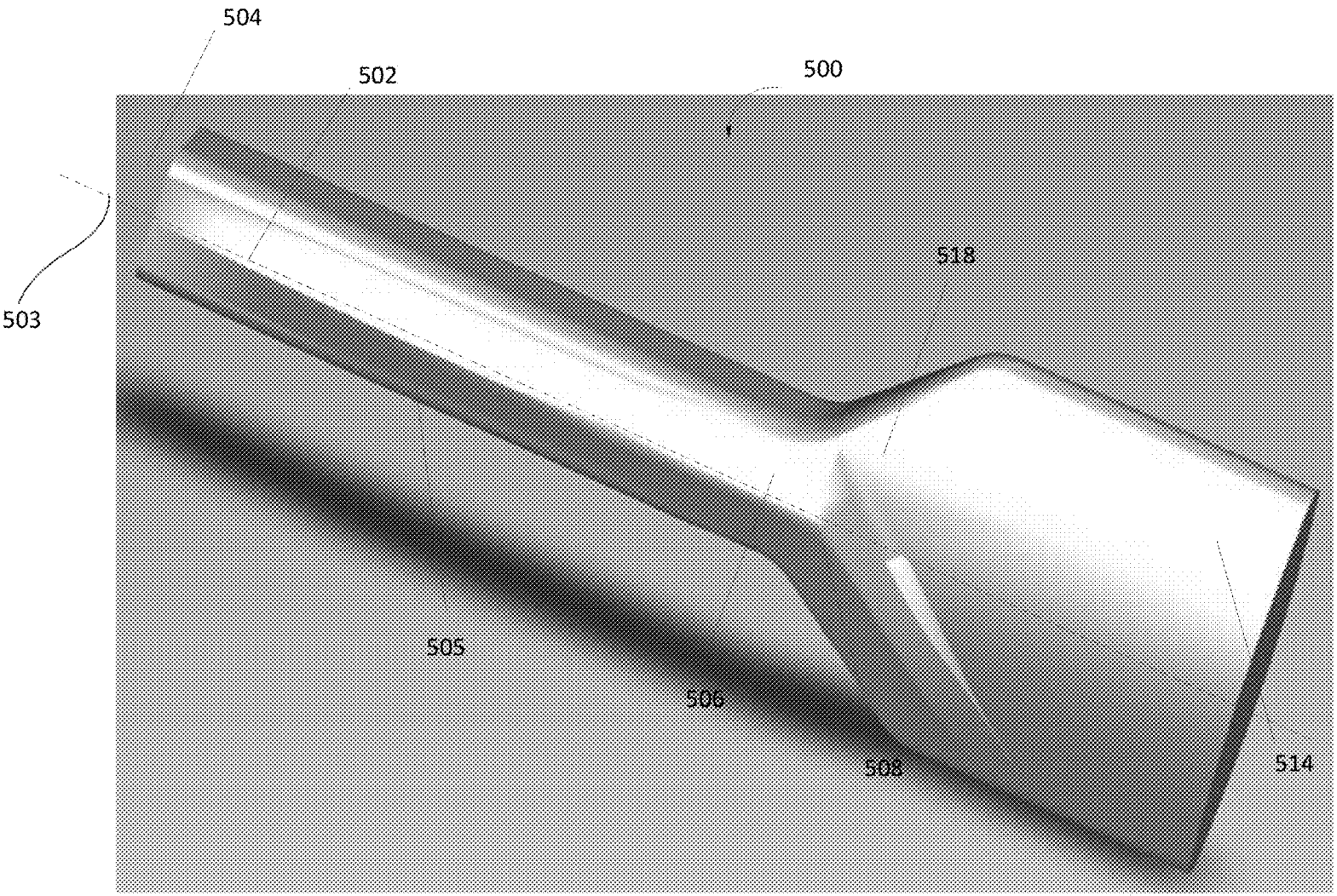
FIGS. 5A and 5B depict a respective front side and back side of another hockey goalie stick, according to one or more aspects described herein.
Figure 5B:
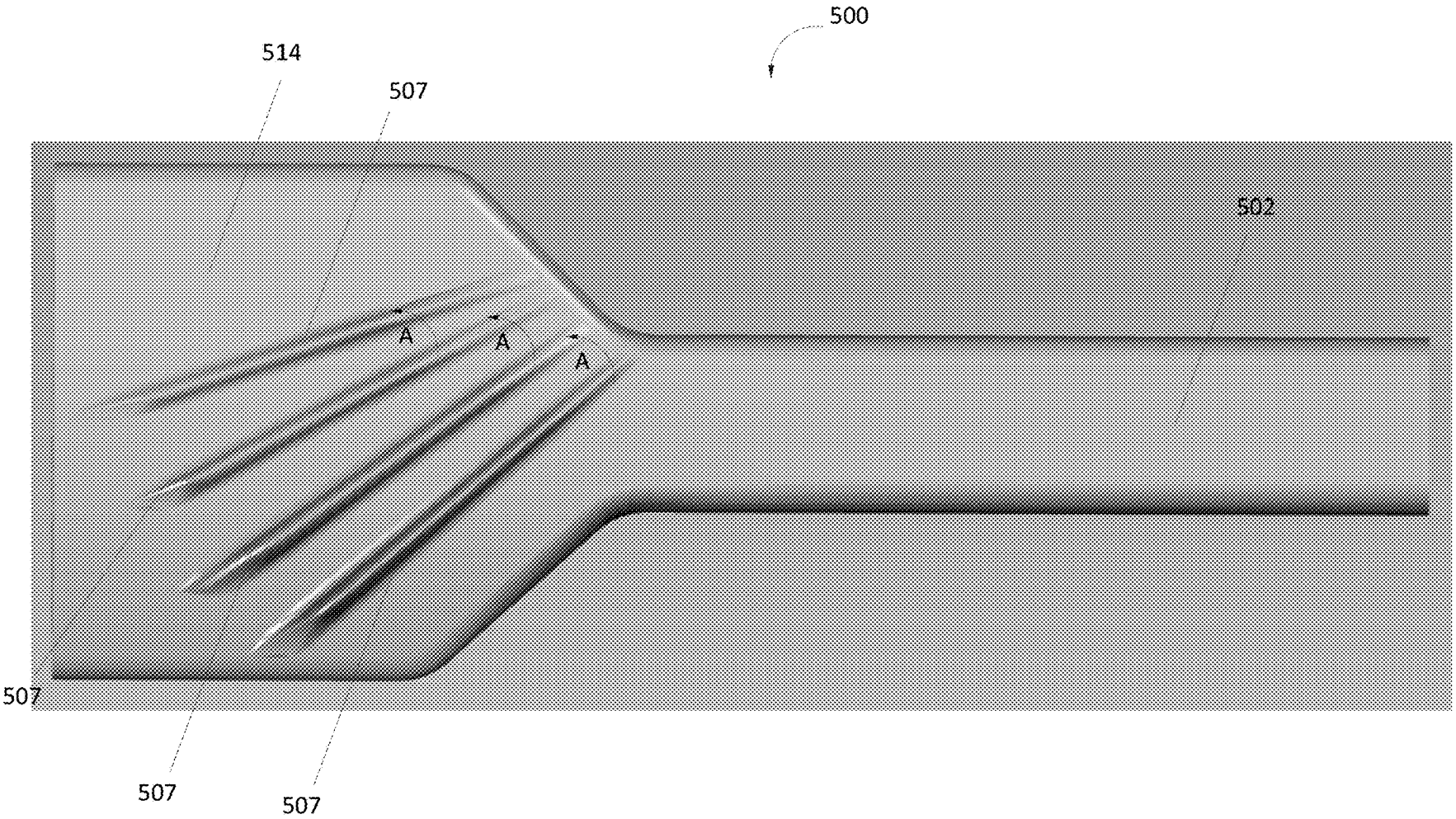

FIGS. 5A and 5B depict a respective front view and rear view of another hockey goalie stick, according to one or more aspects described herein. Hockey stick 500 may include a shaft 502 that has a proximal end 504 and a distal end 506. The shaft may include a rib or gripping structure 505 that may extend longitudinally from the shaft 502 to the proximal end or shoulder 518 of the paddle 514. As shown in FIG. 5B, a second gripping structure 507 may be configured on the opposite side of the paddle 514. The gripping structure may be a finger or thumb grip 507. The gripping structure 505 may be configured on the side of the shaft 502 and bend distally from a longitudinal axis 503 along the shaft and the paddle. The gripping structure 505 may bend at a point 508 proximate the area where shaft 502 connects to the paddle 514. The gripping structure 505 may bend at least 5, 10, 15, 20, 25, 30, 35, 40, or 45 degrees from an imaginary line defined by the longitudinal axis 503 of the shaft and paddle. The portion of the gripping structure 505 that bends may form an angle between the straight portion of the gripping structure configured on the shaft of about 0-5 degrees, 5-10 degrees, 5-15 degrees 10-15 degrees, 10-20 degrees, 10-30 degrees, 10-45 degrees, 15-35 degrees, 25-45 degrees, or 35-45 degrees. The unique contour of the gripping structure 505 is ergonomically optimized to fit the palm of the hand and/or to provide a finger gripping structure to improve handling and control of the stick.

As shown in FIG. 5B, a second gripping structure 507 may be configured on the opposite side of the paddle 514. The gripping structure may be a finger or thumb grip 507. The hockey stick 500 may be configured with at least one, at least two, at least three, at least four, approximately four, or a plurality of second gripping structures 507. The unique contour of the second gripping structure 507 is ergonomically optimized to provide the player a finger or thumb gripping structure to improve handling and control of the stick. The second gripping 507 structure may generally be a generally linear or straight structure. An angle A may be formed between second gripping structures 407. Angle A may be about 0, 5, 10, 15, 20, 25, 30, 35, 40, or 45 degrees, or about 0-5 degrees, 5-10 degrees, 5-15 degrees 10-15 degrees, 10-20 degrees, 10-30 degrees, 10-45 degrees, 15-35 degrees, 25-45 degrees, or 35-45 degrees. Second gripping structure 507 may include a width and a length. For example, the width may be approximately 5 mm and the length may be 80 mm. In other examples, the width may be at least 5 mm and the length may be at least 80 mm. In yet other examples, the width may be at least, greater than, less than, equal to, or any number in between about 1 mm, 2 mm, 3 mm, 4 mm, 5 mm, 6 mm, 7 mm, 8 mm, 9 mm, and 10 mm. In still other examples, the length may be at least, greater than, less than, equal to, or any number in between about 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, 105 mm, 110 mm, 115 mm, 120 mm, 120 mm, 125 mm, 130 mm, 135 mm, 140 mm, 145 mm, and 150 mm.

Figure 6A:
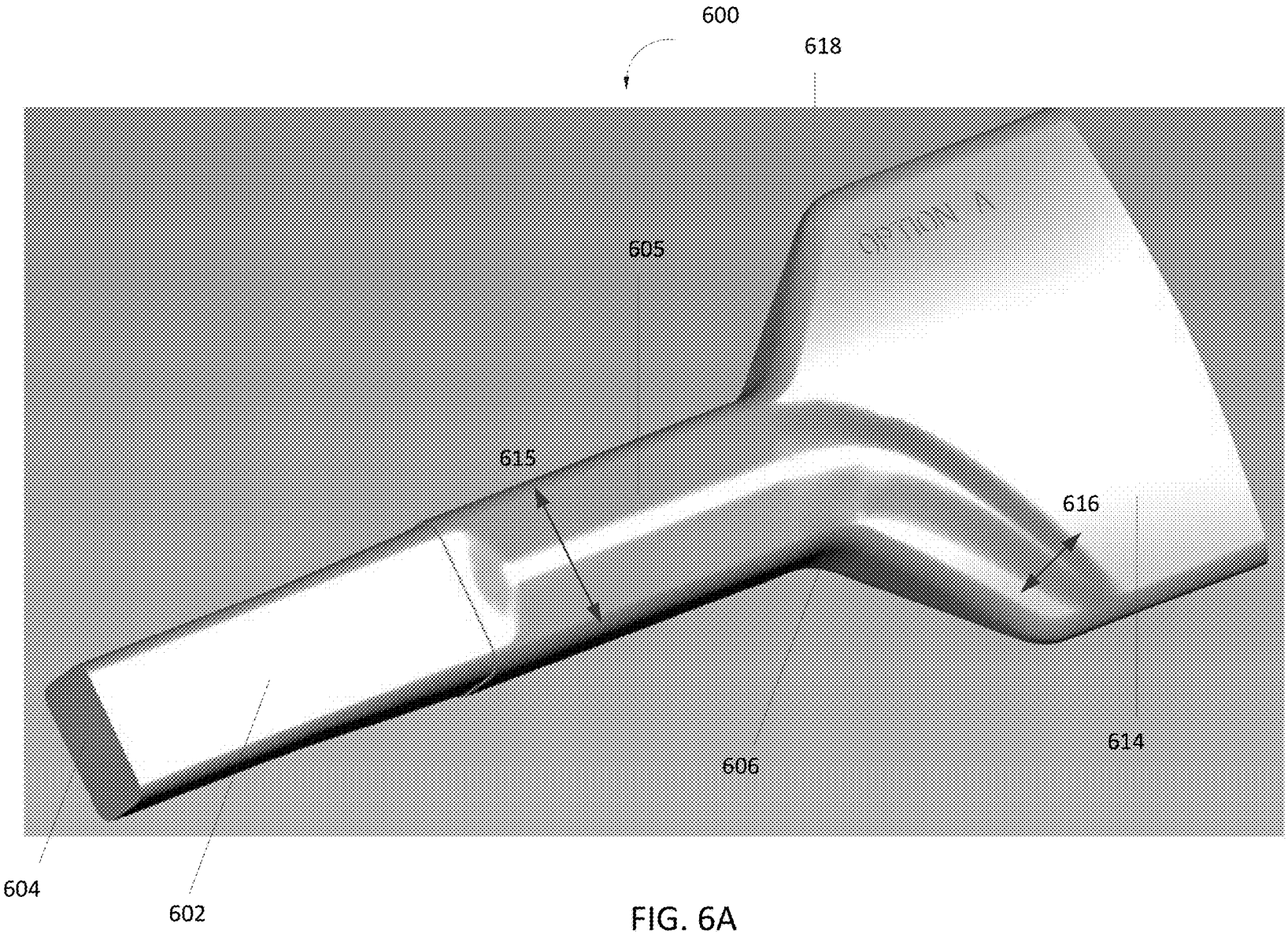
FIGS. 6A and 6B depict a respective front side and back side of another hockey goalie stick, according to one or more aspects described herein.
Figure 6B:
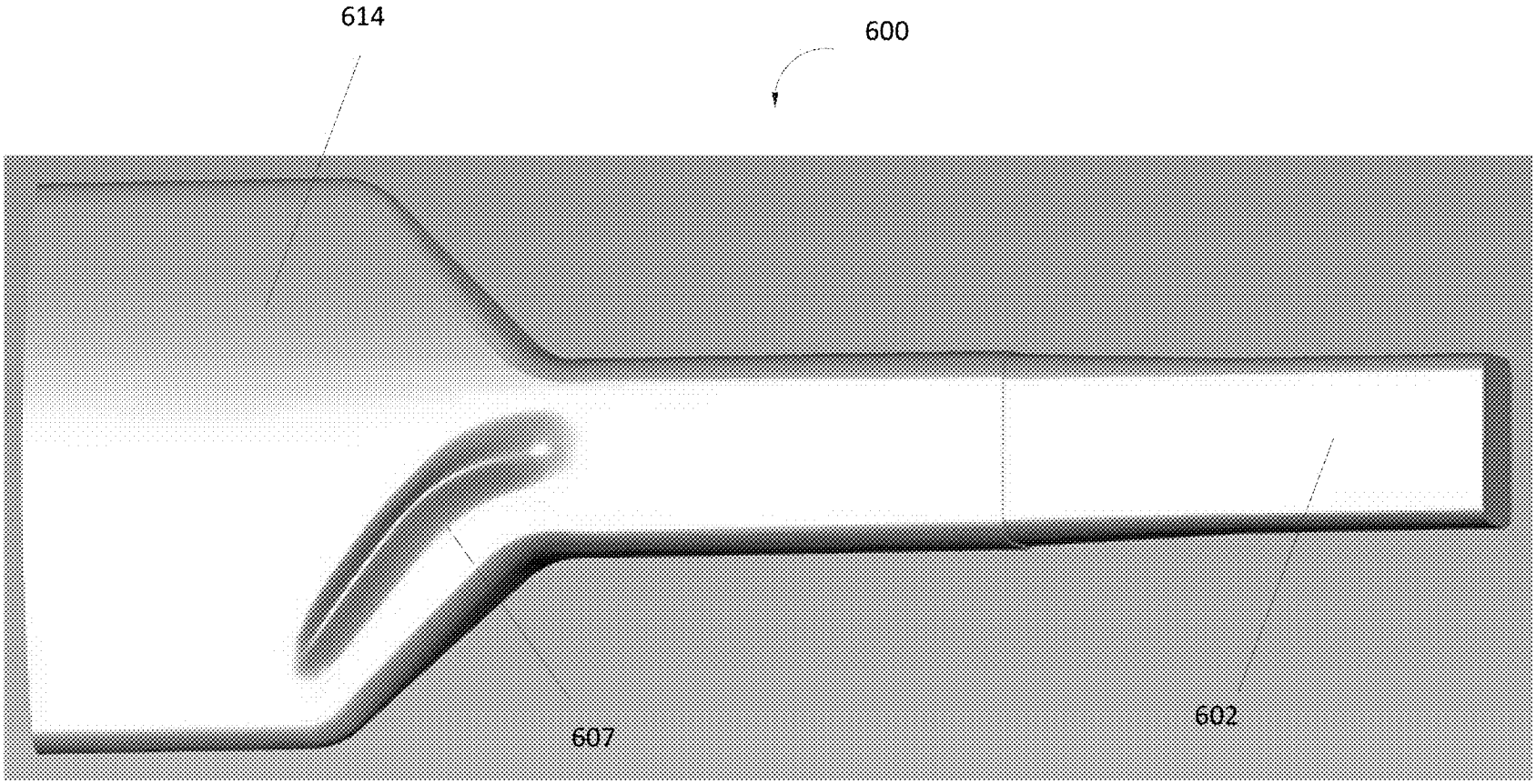

FIGS. 6A and 6B depict a respective front and back of another hockey goalie stick, according to one or more aspects described herein. Hockey stick 600 may include a shaft 602 that has a proximal end 604 and a distal end 606. The shaft may include a rib or gripping structure 605 that may extend longitudinally from the shaft 602 to the proximal end 606 or shoulder 618 of the paddle 614. Gripping structure 605 may include a first end adjacent the proximal end 604 with a first thickness 613*a*. As the gripping structure 605 extends distally from the proximal end 604 to the paddle 614, the thickness may change. The second thickness 613*b* may be less than the first thickness 613*a* in some examples. As shown in FIG. 6B, a second gripping structure 607 may be configured on the opposite side of the paddle 614. The gripping structure may be a finger or thumb grip 607. The second gripping 607 structure may generally be j-shaped or a crescent-shaped structure.

Figure 7A:
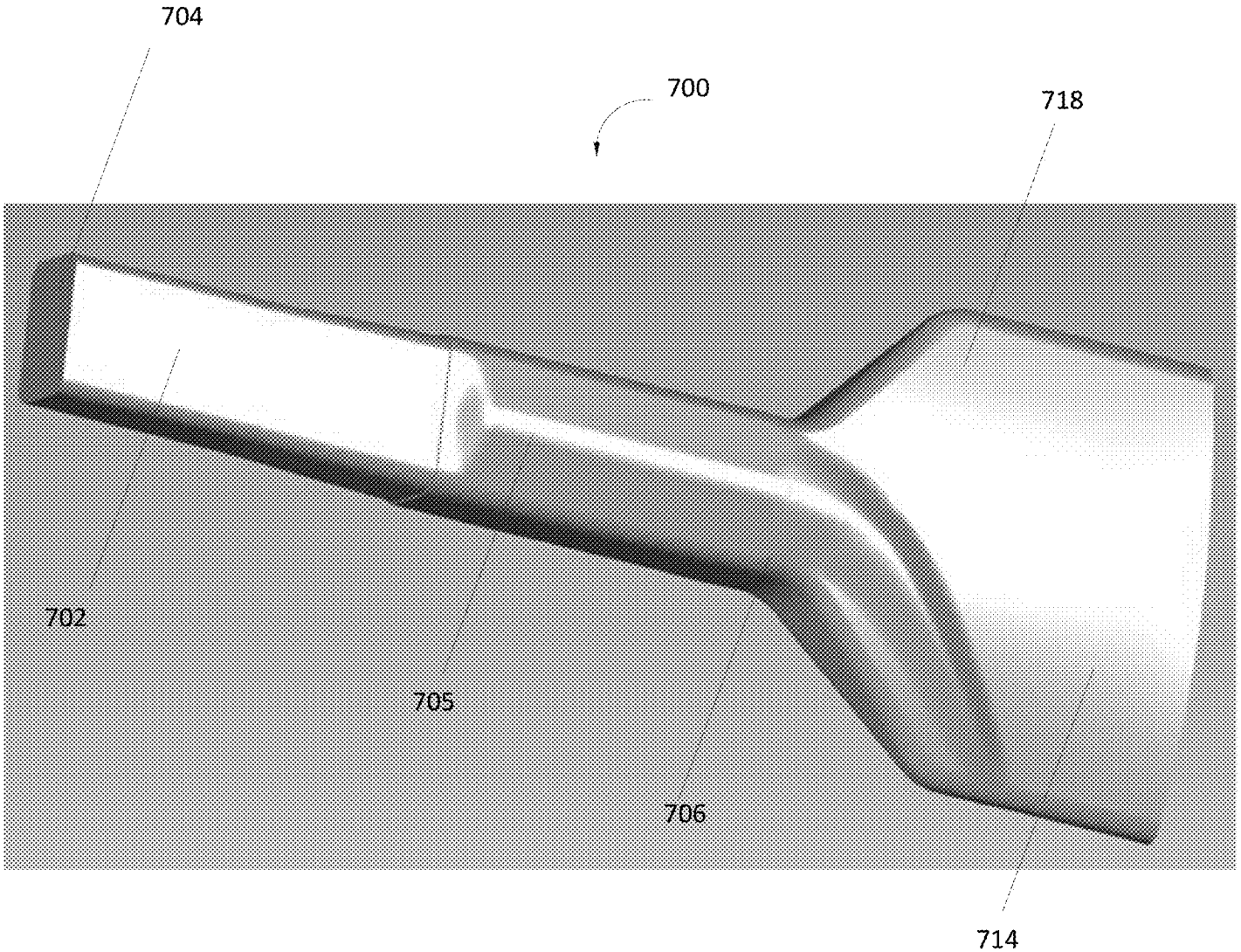
FIGS. 7A and 7B depict a respective front side and back side of another hockey goalie stick, according to one or more aspects described herein.
Figure 7B:
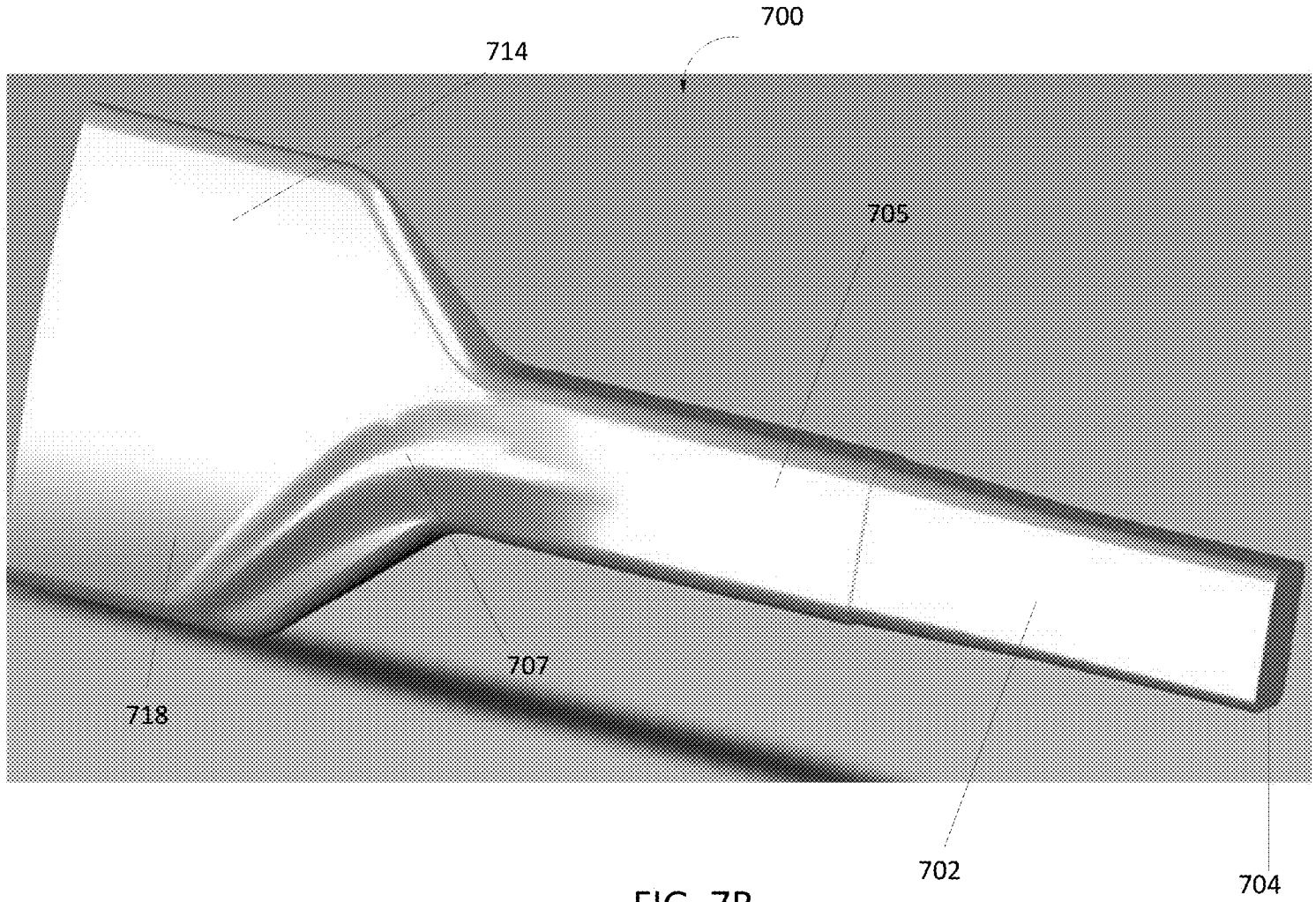

FIGS. 7A and 7B depict a respective front view and rear view of another hockey goalie stick, according to one or more aspects described herein. Hockey stick 700 may include a shaft 702 that has a proximal end 704 and a distal end 706. The shaft may include a first rib or gripping structure 705 that may extend longitudinally from the shaft 702 to the proximal end or shoulder 718 of the paddle 714. As shown in FIG. 7B, a second gripping structure 707 may be configured on the opposite side of the paddle 714. The second gripping structure may be a finger or thumb grip 707. In some examples, the second gripping structure 707 may be a mirror image of the distal portion of the first gripping structure 705.

Figure 8A:
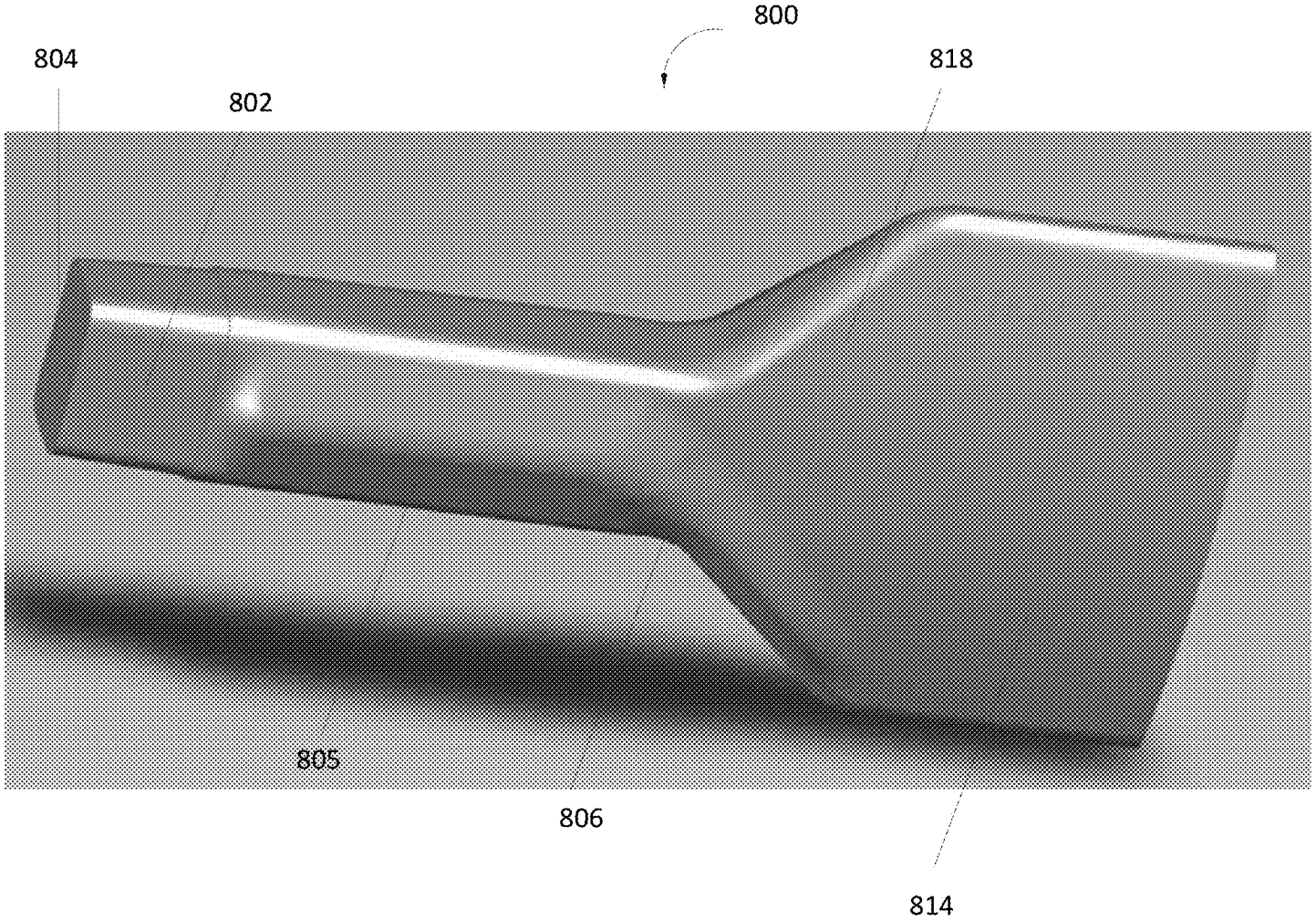
FIGS. 8A and 8B depict a respective front side and back side of another hockey goalie stick, according to one or more aspects described herein.
Figure 8B:
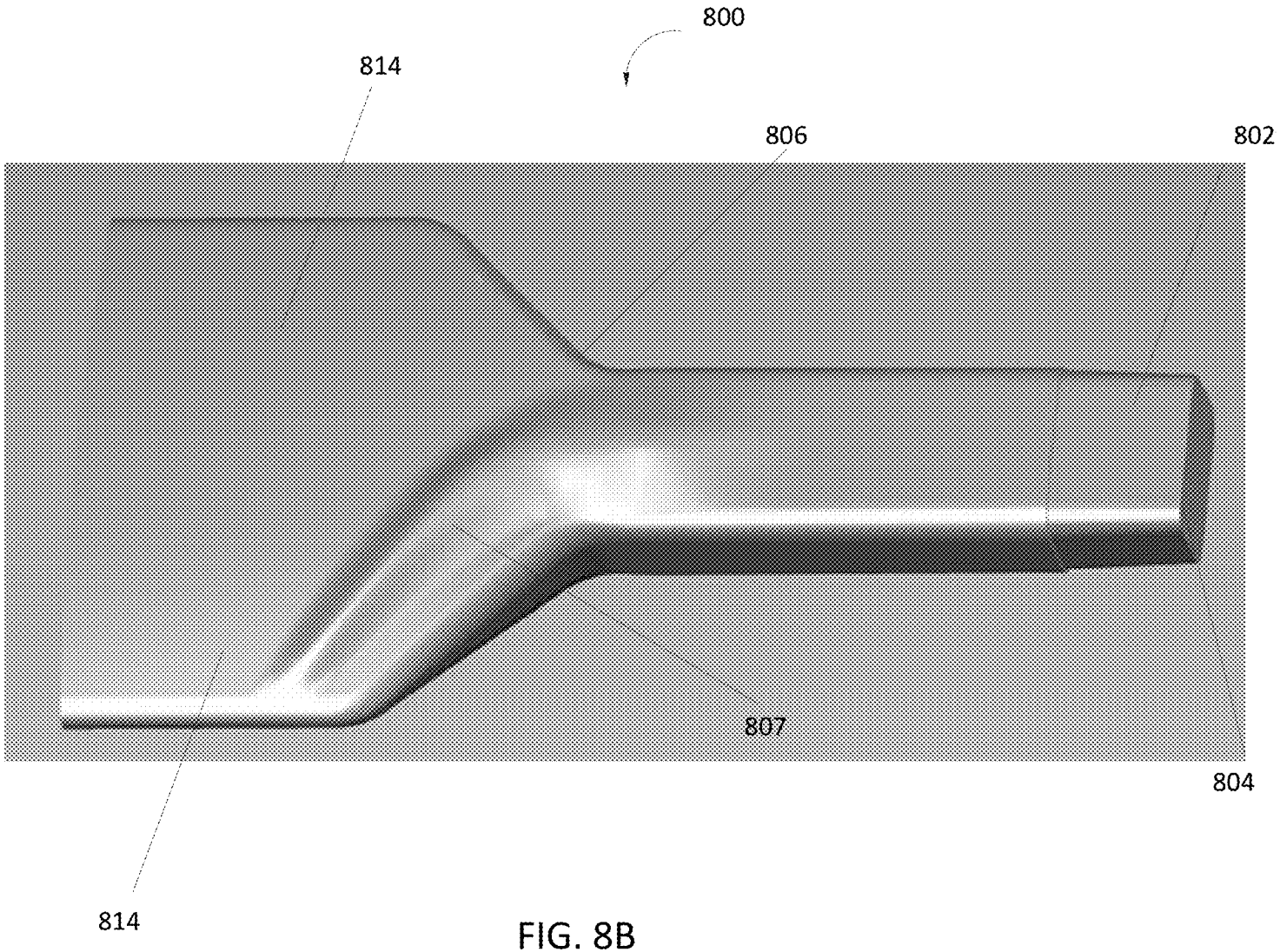

FIGS. 8A and 8B depict a respective front view and rear view of another hockey goalie stick, according to one or more aspects described herein. Hockey stick 800 may include a shaft 802 that has a proximal end 804 and a distal end 806. The shaft may include a first rib or gripping structure 805 that may extend longitudinally from the shaft 802 to the proximal end or shoulder 818 of the paddle 814. As shown in FIG. 8B, a second gripping structure 807 may be configured on the opposite side of the paddle 814. The second gripping structure may be a finger or thumb grip 807. In some examples, the second gripping structure 807 may be a mirror image of the distal portion of the first gripping structure 805.

Figure 9A:
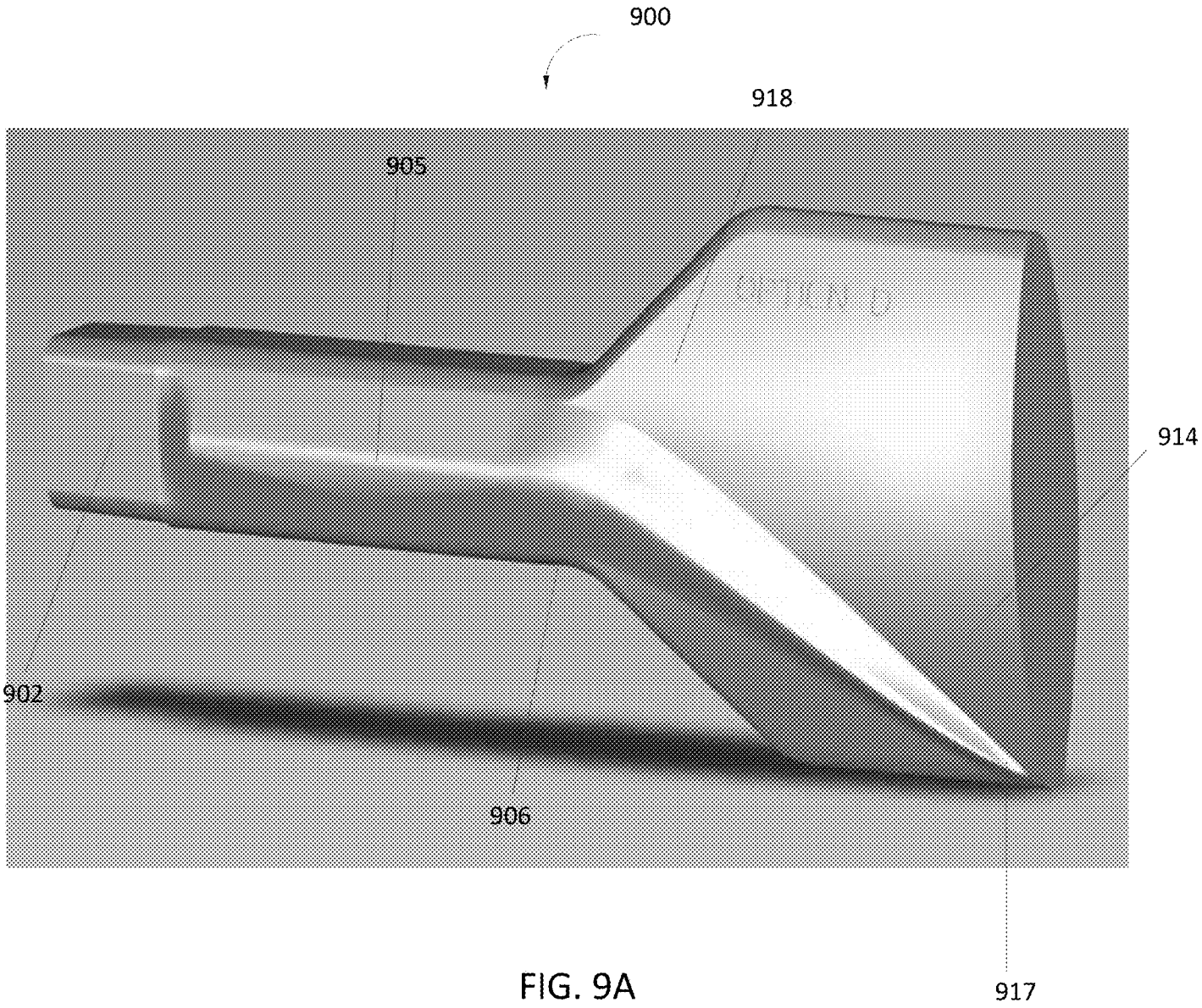
FIGS. 9A and 9B depict a respective front side and back side of another hockey goalie stick, according to one or more aspects described herein.
Figure 9B:
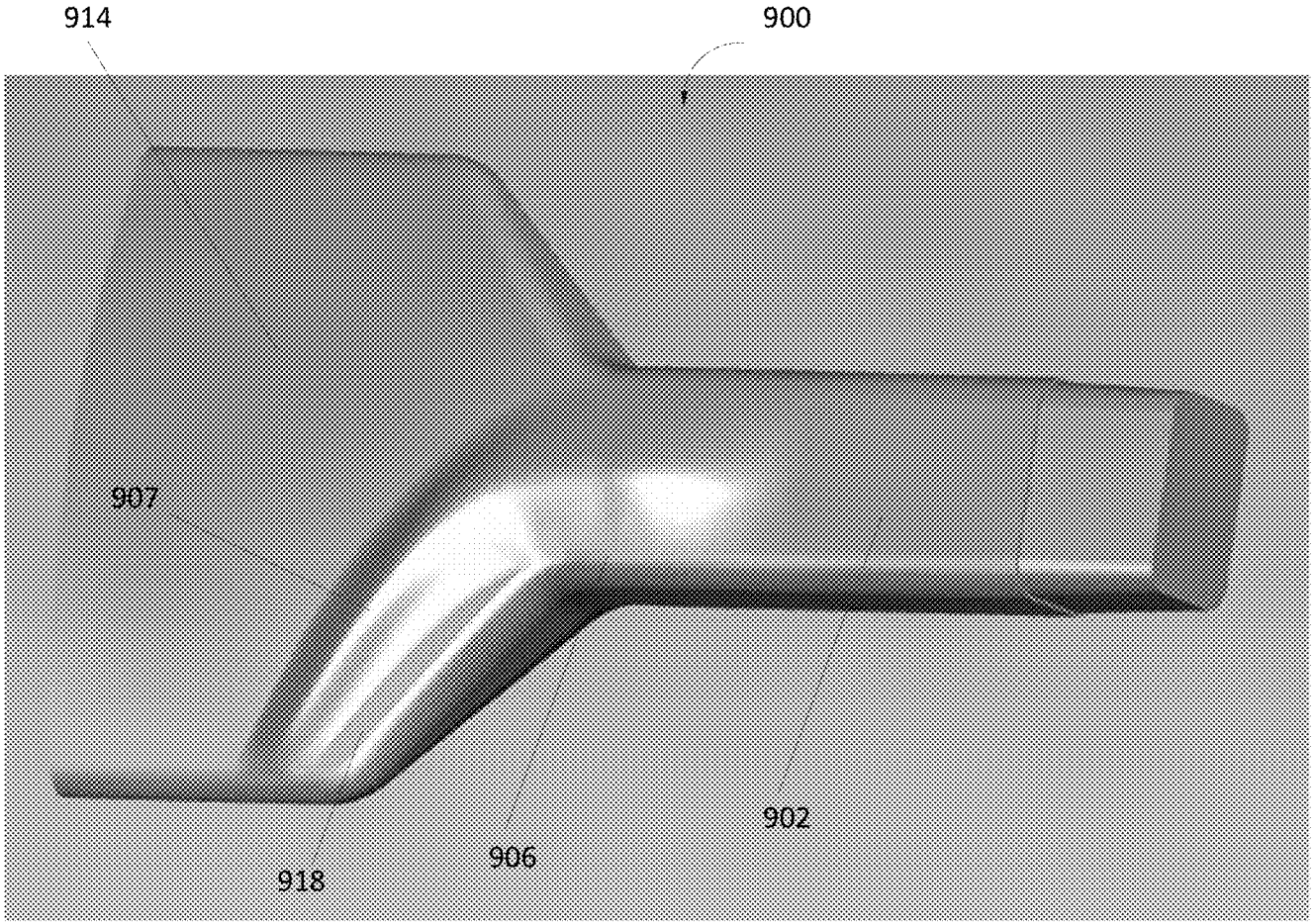

FIGS. 9A and 9B depict a respective front and back of another hockey goalie stick, according to one or more aspects described herein. Hockey stick 900 may include a shaft 902 that has a proximal end 904 and a distal end 906. The shaft may include a rib or gripping structure 905 that may extend longitudinally from the shaft 902 to the proximal end or shoulder 918 of the paddle 914. The distal end of gripping structure 905 may taper to a generally sharp point as depicted in FIG. 9A. As shown in FIG. 9B, a second gripping structure 907 may be configured on the opposite side of the paddle 914. The gripping structure may be a finger or thumb grip 907. In some examples, the second gripping structure 907 may extend from the distal portion 906 of the shaft 902 into the paddle 914 and across the paddle shoulder 918.

Figure 10A:
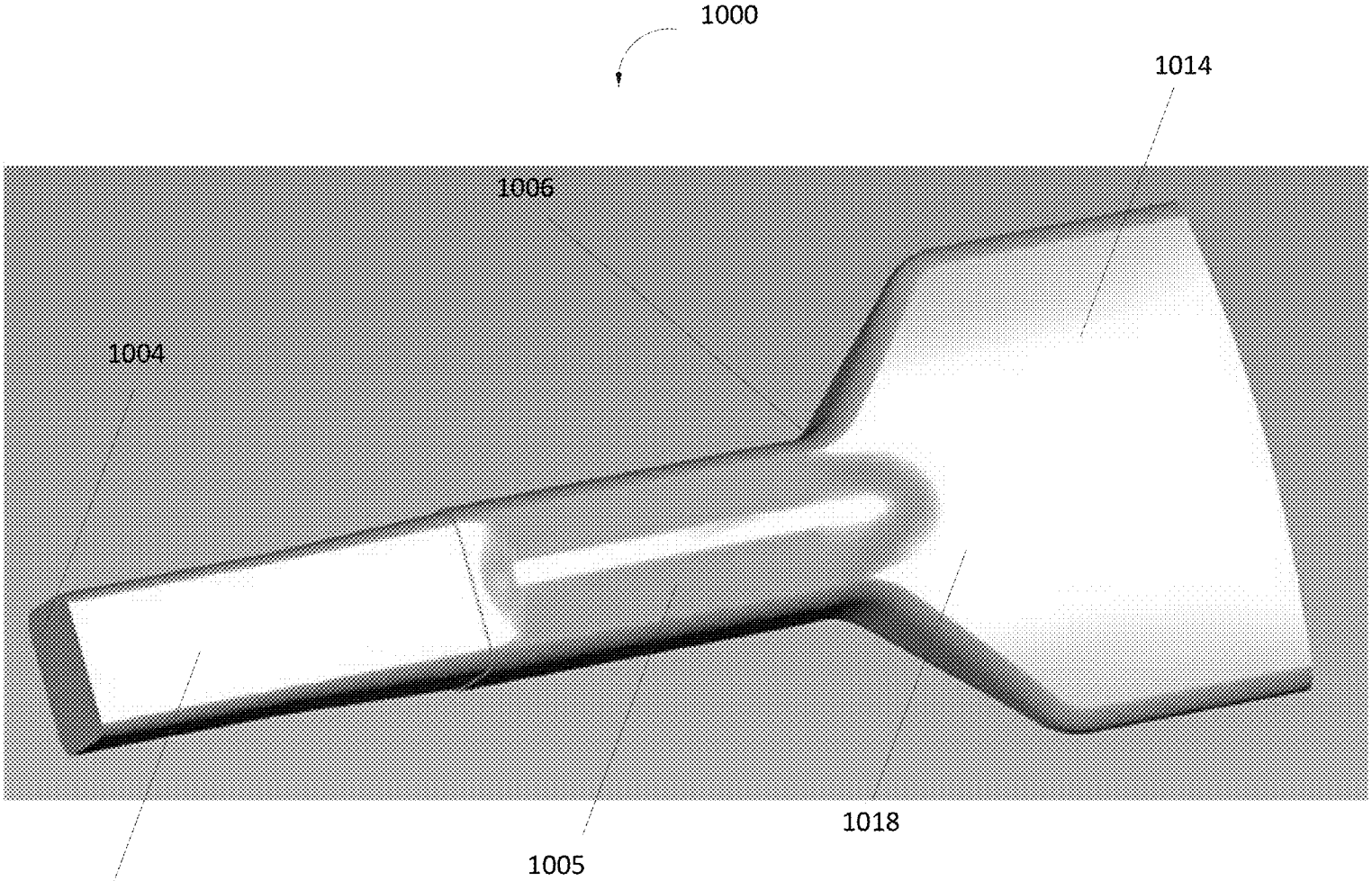
FIGS. 10A and 10B depict a respective front side and back side of another hockey goalie stick, according to one or more aspects described herein.
Figure 10B:
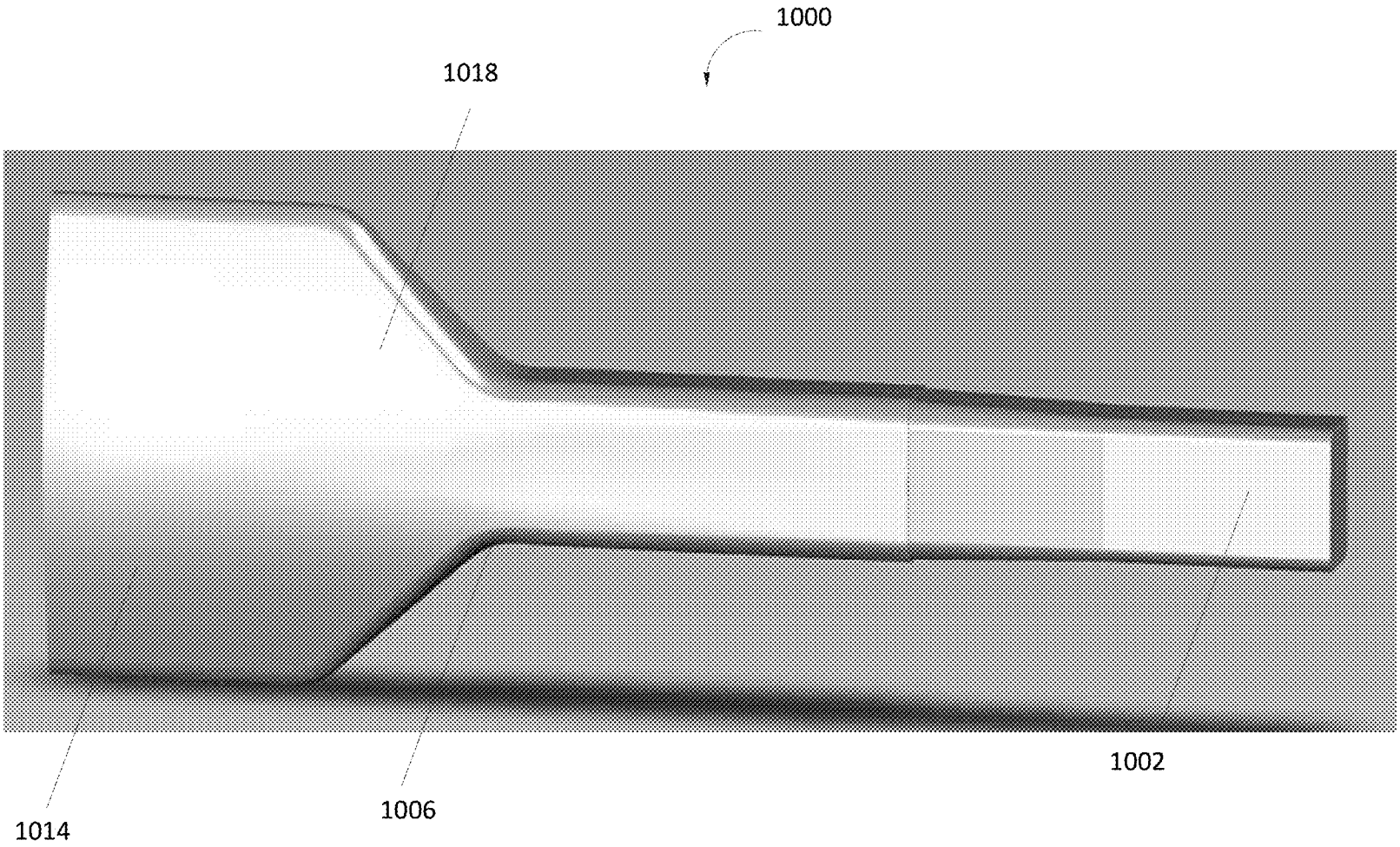

FIGS. 10A and 10B depict a respective front and back of another hockey goalie stick, according to one or more aspects described herein. Hockey stick 1000 may include a shaft 1002 that has a proximal end 1004 and a distal end 1006. The shaft may include a rib or gripping structure 1005 that may extend longitudinally from the shaft 1002 to the proximal end 1006 of the shaft or shoulder 1018 of the paddle 1014. As shown in FIG. 10B, the hockey stick may be configured without a second gripping structure on the opposite side of the paddle 1014.

Figure 11A:
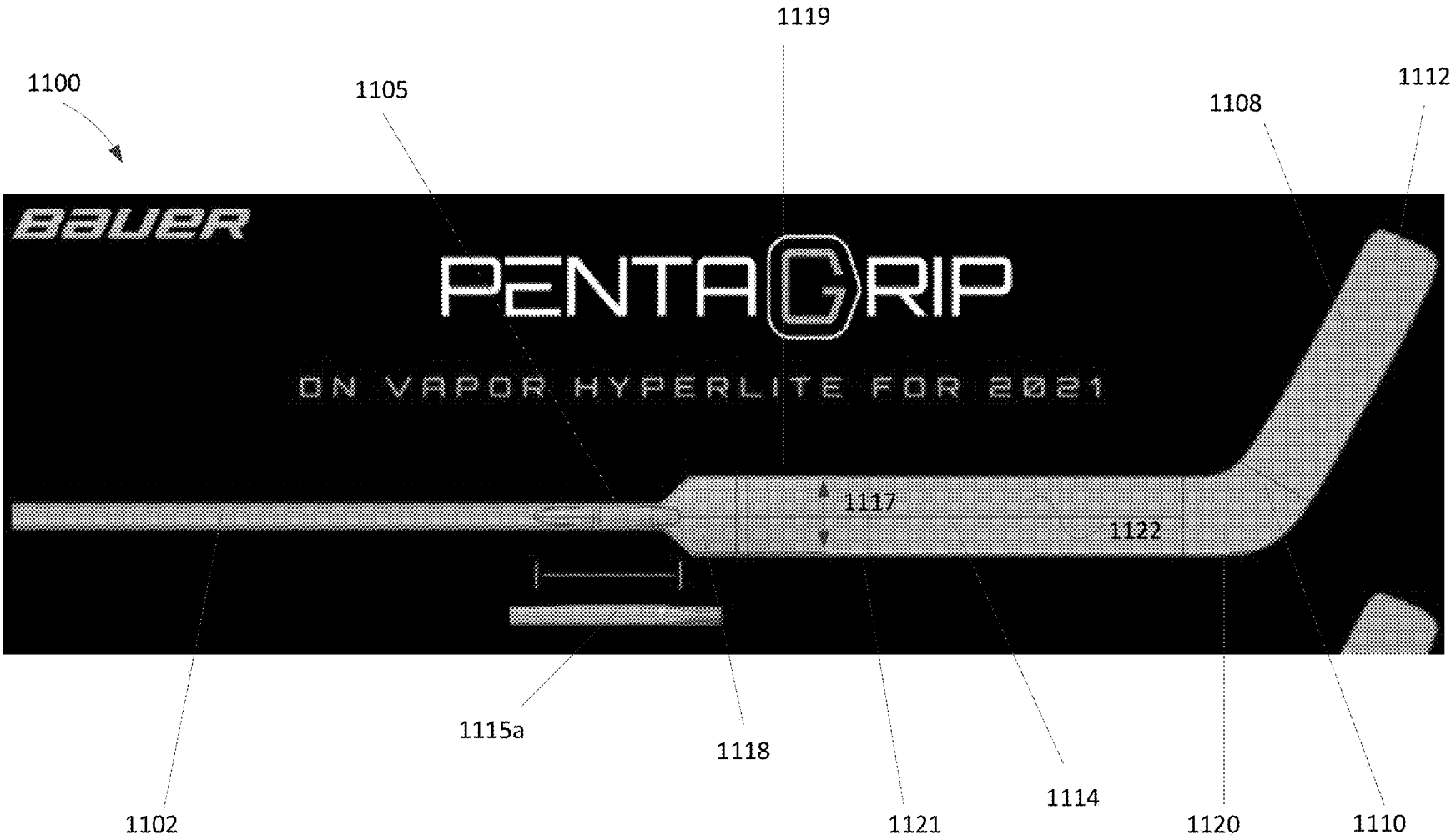
FIGS. 11A and FIG. 11B illustrate an implementation of a hockey stick that has a gripping element on the shaft and paddle, according to one or more aspects described herein.
Figure 11B:
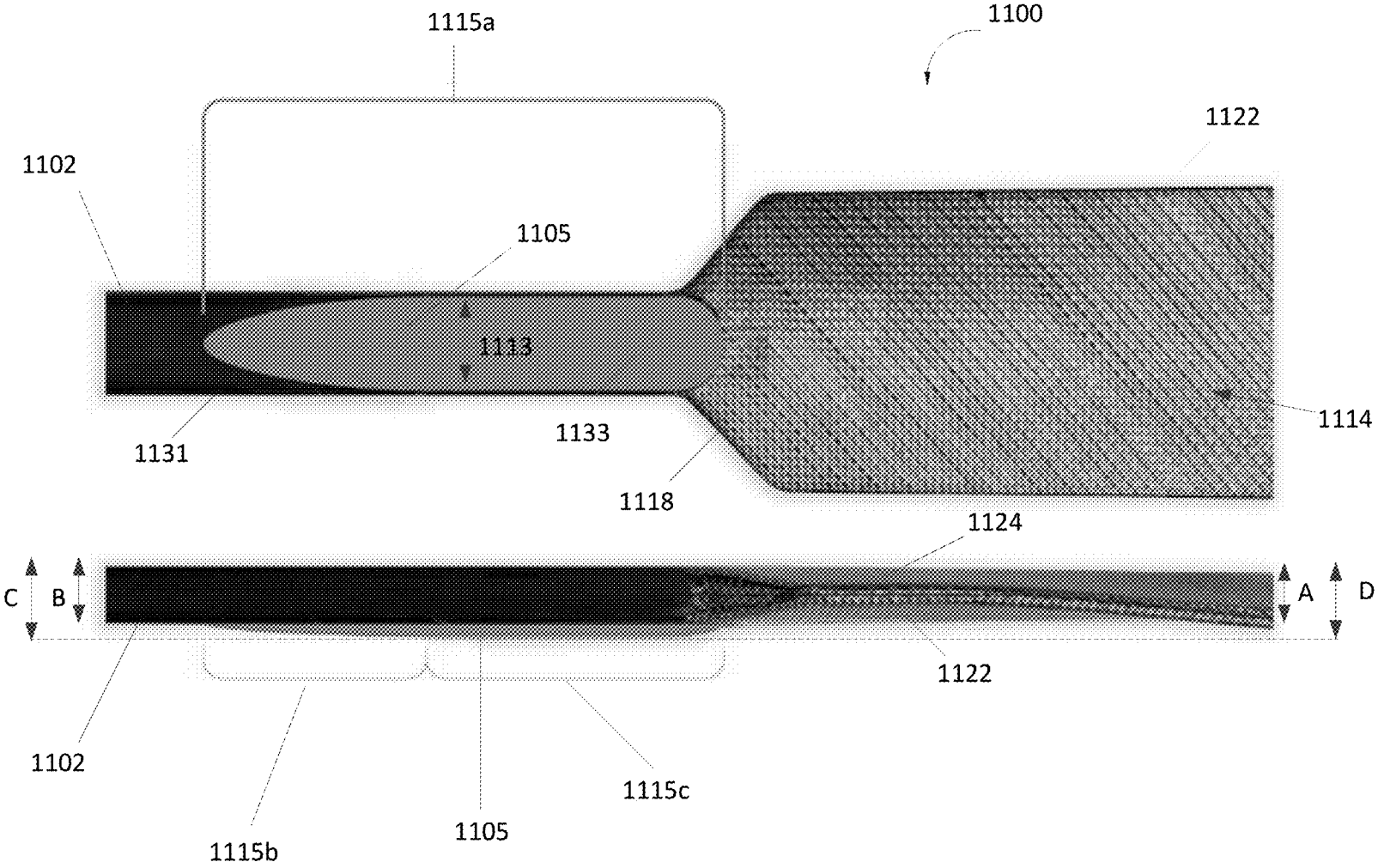

FIG. 11A and FIG. 11B depict an implementation of a hockey goalie stick 1100 that has a variable geometry gripping structure 1105 configured on the shaft 1102 and extending into the paddle 1114 at the paddle shoulder 1118, according to one or more aspects described herein. The hockey stick 1100 may include a blade 1108 that has a proximal end 1110, otherwise referred to as a blade heel 1110 and a distal end 1112, otherwise referred to as a blade toe 1112. The hockey stick 1100 may also include a paddle 1114 that has a length 1116 that extends between a proximal end 1118 and a distal end 1120. The paddle 1114 may also have a width 1117 that extends between a top edge 1119 and a bottom edge 1121. Accordingly, the distal end 1120 of the paddle 1114 may be coupled to the proximal end 1110 of the blade 1108, and the proximal end 1118 of the paddle 1114 may be coupled to the distal end 1106 of the shaft 1102. Additionally, the paddle 1114 may include a front face 1122, and a back face 1124 (not shown). The gripping structure 1105 that may also include a length 1115*a* of about 110 mm. In still other examples, the length may be at least, greater than, less than, equal to, or any number in between about 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, 105 mm, 110 mm, 115 mm, 120 mm, 120 mm, 125 mm, 130 mm, 135 mm, 140 mm, 145 mm, 150 mm, 155 mm, 160 mm, 165 mm, 170 mm, 175 mm, 180 mm, 185 mm, 190 mm, 195 mm, and 200 mm.

As depicted in FIG. 11B rib or first gripping structure 1105 may extend along a portion of the paddle 1114 and shoulder 1118, with the gripping structure 1105 coupled to, and protruding out from the front face 1122 of the paddle 1114. The rib 1105 may have a first length 1115*a* and a second length 1115*a* that is less than the first length 1115*a* of the rib 1105, and a third length 1115*c* that is less than the first length 1115*a* of the rib 1105. In still other examples, the first, second, or third lengths may be at least, greater than, less than, equal to, or any number in between about 5 mm, 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, 105 mm, 110 mm, 115 mm, 120 mm, 120 mm, 125 mm, 130 mm, 135 mm, 140 mm, 145 mm, 150 mm, 155 mm, 160 mm, 165 mm, 170 mm, 175 mm, 180 mm, 185 mm, 190 mm, 195 mm, and 200 mm. Gripping structure 1105 may also include a thickness 1113. The rib 1105 may include a proximal end 1131 and a distal end 1133. The paddle 1114 may have a thickness labeled A and the shaft 1102 may have a thickness labeled B. The shaft 1102 thickness A and a height of the gripping structure 1105 may be combined for a second thickness or height labeled C. The paddle 1114 first thickness may be measured between the front face 1122 and the back face 1124 of the paddle 1114. Further, the paddle 1114 may have a second thickness labeled D, greater than the first thickness A, measured between the top of the rib 1105 and the back face 1124 of the paddle 1114.

Figure 12:
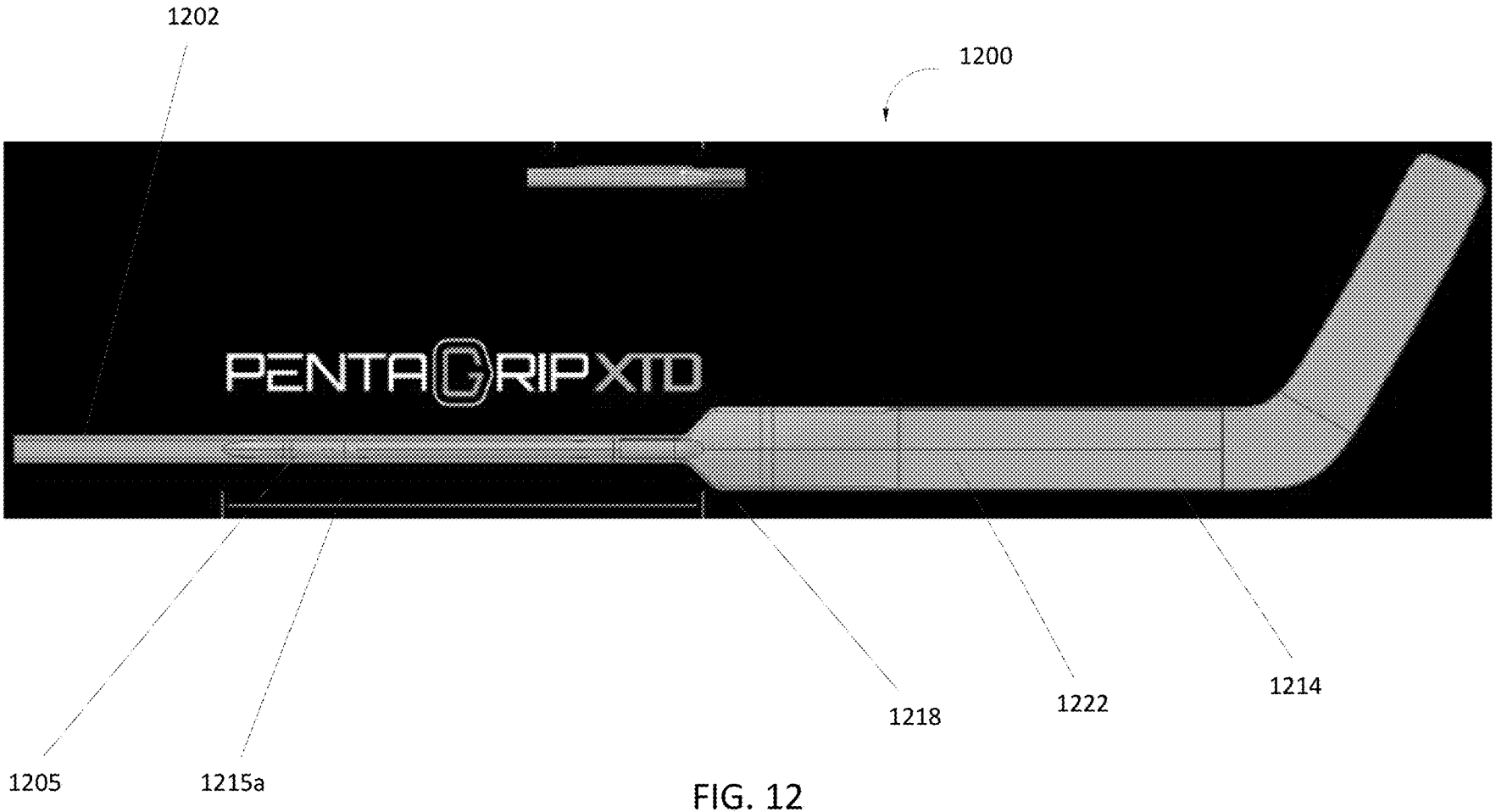
FIG. 12 depicts an implementation of another hockey stick that has an extended gripping element on the shaft and paddle, according to one or more aspects described herein.

FIG. 12 schematically depicts an implementation of the hockey stick of FIG. 11A that has an extended gripping element 1205 on the shaft 1202 and paddle 1214. The shaft 1204 and the paddle 1214 may include a gripping structure 1205 that may extend along a portion of the paddle 1214 shoulder 1218, with the gripping structure 1205 coupled to, and protruding out from the front face 1222 of the paddle 1214 and the palm side of the shaft 1202. The gripping structure 1205 may have a length 1215*a* extending longitudinally from the shoulder 1218 to a proximate end of the shaft. The extended length 1215*a* of the gripping structure 1205 may be about 20 cm. In still other examples, the extended length may be at least, greater than, less than, equal to, or any number in between about 5 mm, 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, 105 mm, 110 mm, 115 mm, 120 mm, 120 mm, 125 mm, 130 mm, 135 mm, 140 mm, 145 mm, 150 mm, 155 mm, 160 mm, 165 mm, 170 mm, 175 mm, 180 mm, 185 mm, 190 mm, 195 mm, and 200 mm.

Figure 13:
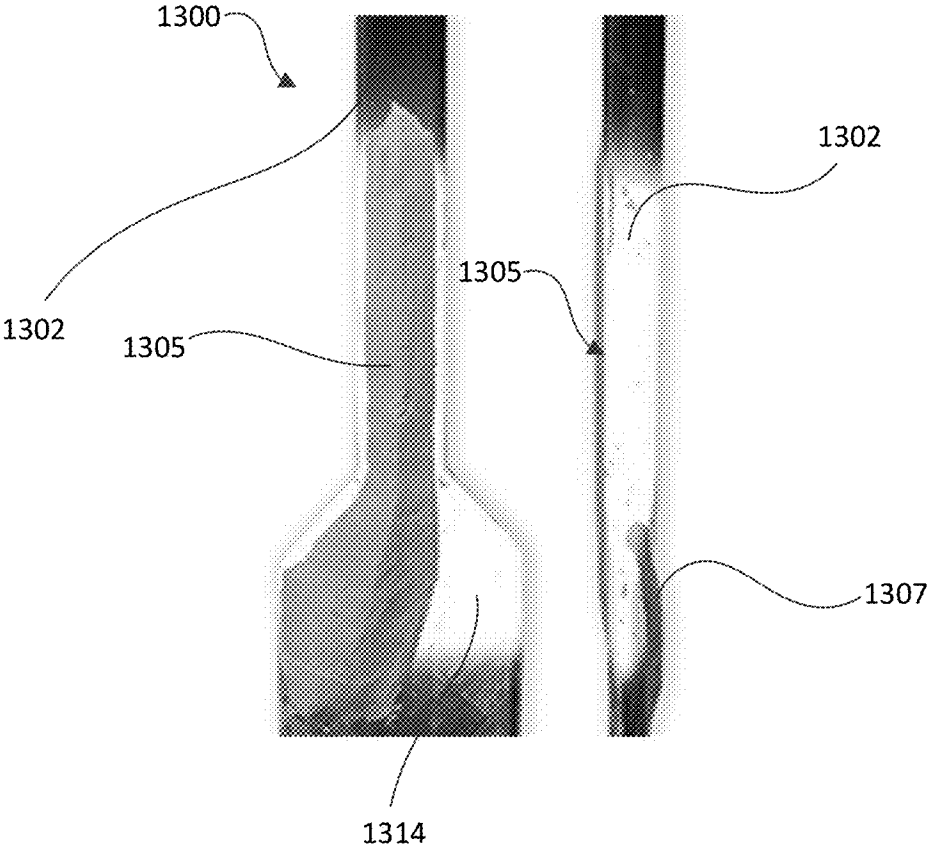
FIG. 13 illustrates a respective front view and side view of the forming of another hockey goalie stick, according to one or more aspects described herein.

In one implementation shown in FIG. 13, it is contemplated that the shaft 1302, the paddle 1314, the first gripping structure 1305, and/or the second gripping structure 1307 are integrally molded as a structure. In another implementation, the shaft 1302, paddle 1314, the gripping structures 1305, 1307, and blade (not shown) may all be integrally molded as a single hockey stick structure 1300.

Figure 14:
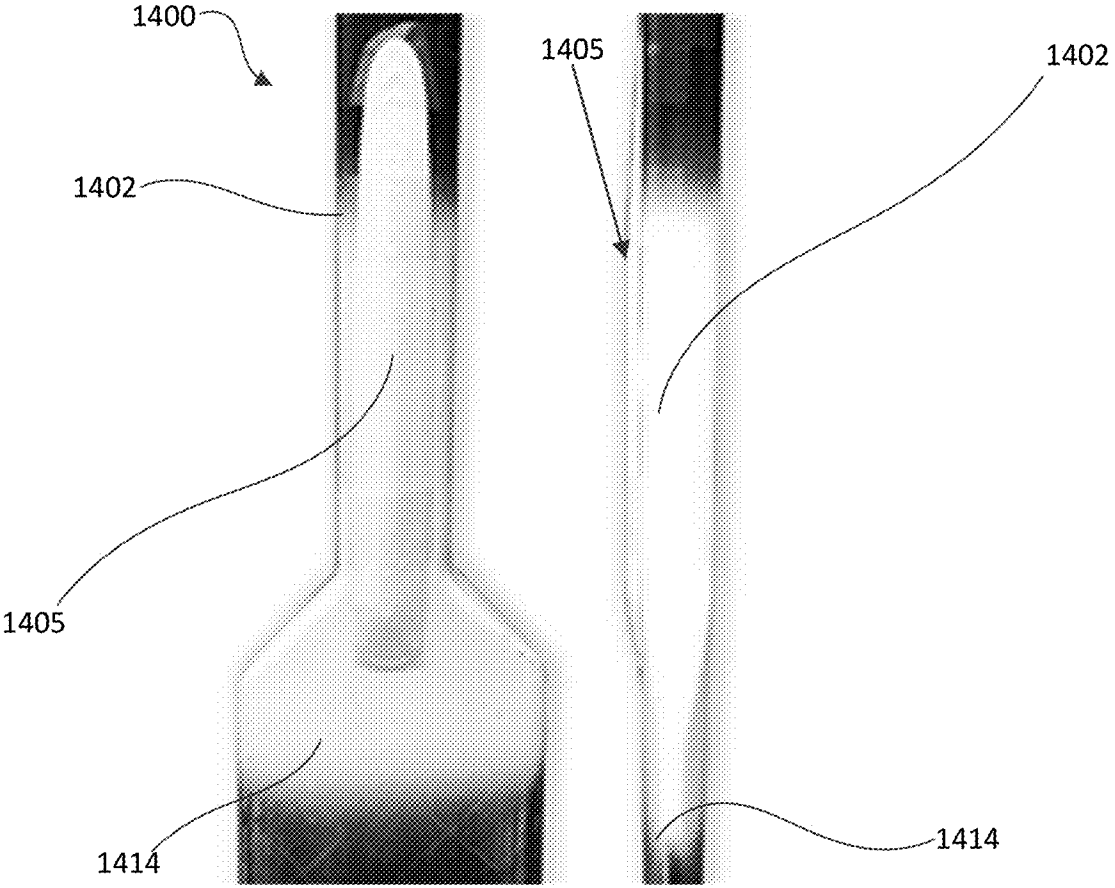
FIG. 14 illustrates a respective front view and side view of the forming of another hockey goalie stick, according to one or more aspects described herein.
Figure 15:
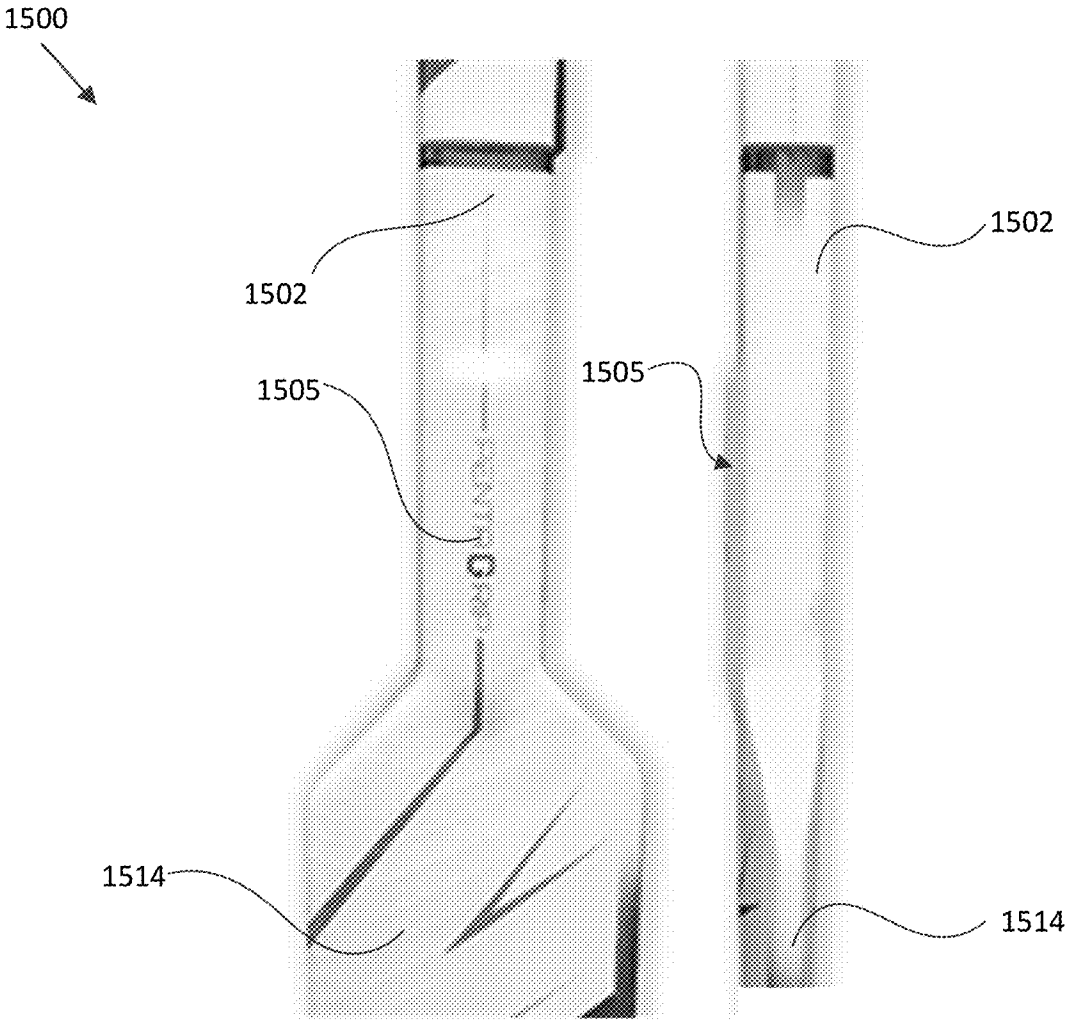
FIG. 15 illustrates a respective front view and side view of forming of another hockey goalie stick, according to one or more aspects described herein.

As shown in FIG. 14, it is also contemplated that a complete hockey stick structure 1400 may be integrally molded from one or more subcomponents, such as a paddle 1414 and gripping structure 1405 that may be formed and/or molded separately before a final one or more molding or overmolding process to produce an integrally molded hockey stick 1400. In particular, the shaft 1402, the paddle 1414, and the blade may be molded together during a first set of molding processes, and the rib/gripping structure 1405 may be rigidly coupled to the shaft 1402, the paddle 1414, and blade structure using one or more subsequent processes to form a final hockey stick 1500 as shown in FIG. 15. Additionally or alternatively, one or more of the gripping structure(s), may be configured to be removably coupled to the final hockey stick structure by adhesive or other attachment means. It is additionally contemplated that the hockey stick 1500 may include additional or alternative elements, such as a tacky outer surface on the shaft 1502 and/or paddle 1514 to provide enhanced grip for a player, and/or an end cap a proximate end of the shaft 1502, without departing from the scope of these disclosures.

Advantageously, the elements of the gripping element(s) disclosed herein may provide enhanced structural and weighting characteristics to the paddle and shaft and may provide enhanced structural and weighting characteristics to the overall hockey stick. In one example, the gripping structure may also be configured to provide structural rigidity that includes resistance to bending and/or torsion of the paddle and/or shaft. Given the structural rigidity provided by rib/gripping structure, the back face of the paddle may also include one or more finger grips/gripping structures as additional elements not found on conventional hockey stick paddles. Accordingly, the depicted implementation of the hockey stick paddle, as shown in FIG. 11A, for example, may include less structural material than conventional implementations to achieve equal or better structural rigidity, and thereby reduce the overall mass of the paddle 1114 and stick 1100. Further, the structure provided by the gripping structure 1105 may allow the front face 1122 to be constructed from additional layers of material (e.g. carbon fiber tape), and thereby increase the impact resistance and mass of the front face 1122, while reducing the overall mass of the paddle 1114, when compared to conventional paddle implementations. It is also contemplated that additional or alternative implementations may be utilized, such that the front face 1122 of the paddle 1114 may have further increased impact strength, without departing from the scope of these disclosures.

Additional gripping structure geometries are contemplated, without departing from the scope of these disclosures. For example, the cross-sectional geometry of the shaft and gripping structure may have a circular or semicircular cross-section, or a triangular cross-section, or other polygonal geometries. Indeed, the cross-sectional geometry of the shaft and gripping structure may include any prismal geometry, without departing from the scope of these disclosures. It is further contemplated that the gripping structure, as shown in FIGS. 11A and 12 (1105, 1205), for example, may be partially or wholly hollow and have a cavity extending along at least a portion of the structure in a direction approximately parallel to the longitudinal axis of the paddle 1114, 1214 and shaft 1102, 1202.

FIGS. 13 and 14 depict a stage of a process for fabricating a hockey stick shaft, paddle, and gripping structure described in relation to FIGS. 2 through 12. In certain examples, the method may include forming a first foam core of a blade structure, shaft, and/or gripping structure. The foam cores may be wrapped with a layer of fiber tape to form a wrapped blade core, a shaft core, and/or a gripping structure core. In certain examples, the foam cores may be a polymethacrylimide (PMI) foam. In one specific example, a Resin Infusion Manufacturing Aid (RIMA) low density PMI foam may be utilized in the foam core. This type of foam is a high strength foam that can withstand the shear and impact forces that result when a hockey blade strikes a hockey puck or when a hockey puck strikes a hockey goalie stick. Also, in certain examples, multiple core structures can make up the core of the blade. The multiple core structures may also be formed of varying density core structures. In certain examples, a higher density core can be placed toward the bottom of the hockey blade where many of the impacts occur, and a lower density core may be placed at the top of the blade. The core may also include epoxy and may also be formed with expandable microspheres. However, it is contemplated that additional or alternative foam materials may be utilized to construct the foam core, without departing from the scope of these disclosures. In an alternative example, the foam core may be removed following one or more molding processes of the hockey stick blade, shaft, and/or gripping structure. As such, the final blade, shaft, and/or gripping structure may be formed of composite structures, carbon fiber walls that are reinforced by pins and molded with epoxy. In this alternative example, the foam may be removed by one or more mechanical processes (one or more machine tools may be utilized to remove the foam core, chemical processes (the foam may be degraded/dissolved by the addition of/exposure to a reactant/catalyst/solvent). Alternatively, the gripping structure may be formed separately by plastic of foam injection molding. The gripping structure may then be secured to a carbon pre-molded shaft via glue or other suitable adhesive. The gripping structure and shaft may then be overmolded or wrapped with a second layer of fiber tape to form a wrapped shaft core and gripping structure.

The paddle may be formed by layering one or more layers of fiber tape. These one or more layers of fiber tape form the front face and the back face, which are similar to the front face and back face of paddle. A spine may be formed by wrapping a mandrel with one or more layers of fiber tape. In one example, the mandrel may be constructed from a silicone material, and may be removed from the spine following one or more molding processes, producing a hollow spine structure. The paddle may include transition elements that may be formed by wrapping transition element foam cores with one or more layers of fiber tape. It is contemplated that the transition element foam cores may include one or more of the same foam materials as the hockey blade foam core. The spine may be positioned on the paddle back face, a transition element may be positioned at a proximal end the back face, and another transition element may be positioned at a distal end of the paddle back face.

One or more additional layers of fiber tape may be wrapped around the paddle front face, the spine, and the transition elements positioned on the back face, to form a wrapped paddle structure. Prior to one or more molding processes, this wrapped paddle structure may be loosely positioned proximate, or coupled to the wrapped blade core by one or more structural elements (interlocking or otherwise), fasteners, adhesives and/or layers of fiber tape, and/or coupled to a gripping structure.

It is contemplated that the systems and methods described herein directed to a gripping structure coupled to a hockey stick shaft and/or paddle, and blade structure of a hockey stick may utilize carbon fiber-reinforced structural elements that are molded together. The carbon-fiber may be applied as one or more tape layers that are pre-impregnated with epoxy, and which are heated and cooled to bond the structural elements together. However, it is contemplated that the systems and methods described herein may be applied to hockey stick implementations using additional or alternative materials, including thermoplastics reinforced with carbon or glass fibers (short or long fibers), thermoset resins reinforced with carbon, glass, aramid, basalt, plastic fibers (such as polypropylene or polyethylene, among others), and/or non-reinforced thermoplastics and thermosets (polyurethane, polyether ether ketone (PEEK) and/or nylon, among others).

It is further contemplated that the various structures described throughout this disclosure may utilize certain reinforced structures that form bridges between the shaft or the paddle and the gripping structure. In one example, the core forming the shaft, blade, gripping structure, or the paddle can be formed of multiple core elements that are individually wrapped with one or more of pre-preg or dry fibers. In this example, when the shaft, blade, gripping structure, or paddle is molded the fibers can create one or more bridges between the faces of the blade or the paddle. Further details pertaining to such manufacturing methods are described in U.S. Pat. Nos. 7,097,577, 7,850,553, and 7,789,778, the entire contents of which are incorporated herein by reference for any and all non-limiting purposes. In other examples one or more fibers can be inserted into the core structure(s) to create one or more bridges between the faces of the blade or the paddle. In another example, fiber pins (e.g. carbon fiber pins) may be injected into a foam core prior to molding of fiber-tape around the foam core. These fiber pins may provide enhanced strengthening to the various structural elements. Further details of this pin reinforcement methodology are described in U.S. patent application Ser. No. 15/280,603, filed 29 Sep. 2016, and U.S. Pat. Nos. 10,456,640 and 10,596,431, the entire contents of which are incorporated herein by reference for any and all non-limiting purposes.

It is also contemplated that any heating temperature and duration may be utilized, without departing from the scope of these disclosures. Further, any heating technology may be utilized, without departing from the scope of these disclosures. In one implementation, a molded hockey stick structure(s) may be passively or actively cooled within, or following removal from the mold. Additionally, it is contemplated that the mold structure used to form the geometry of the hockey shaft, blade, gripping structure, and paddle may utilize female-female, or female-male, and/or or male-male mold configurations.

As shown in FIG. 15, it is further contemplated that the molded hockey 1500 may have one or more layers of a polymer coating applied to the molded structure 1500, and which may include graphics and stick colorations, without departing from the scope of these disclosures.

Figure 16A:
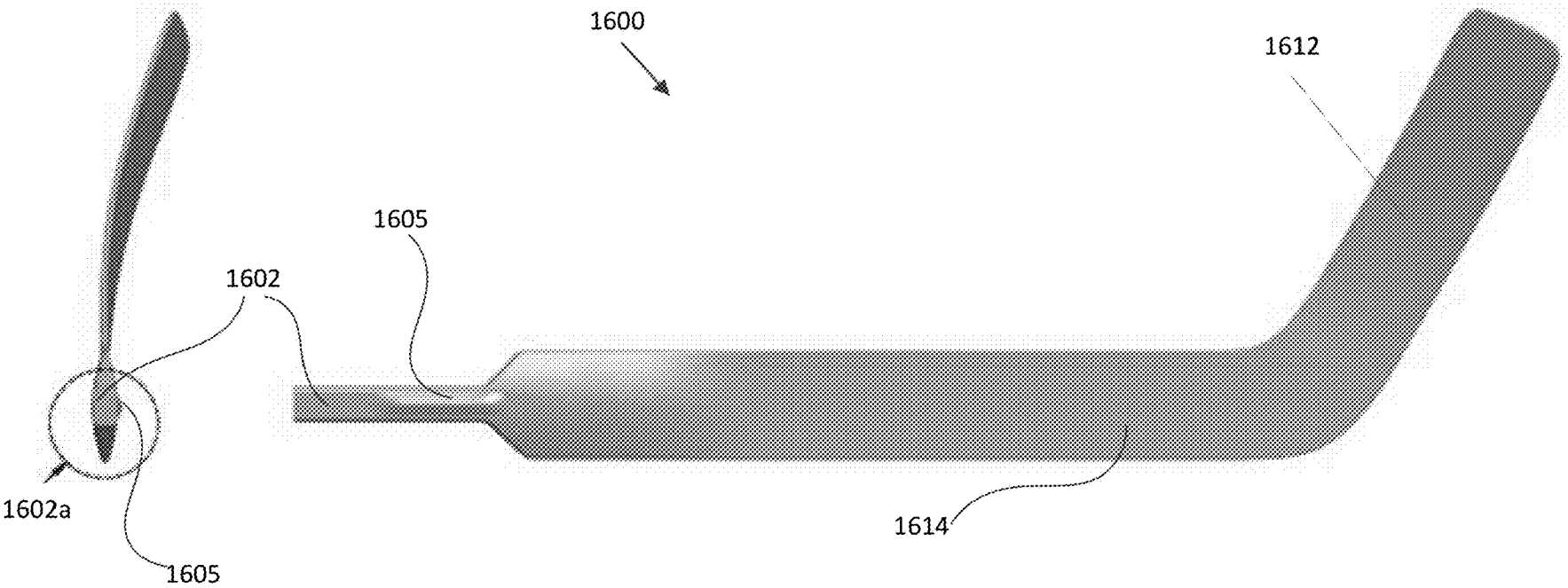
FIG. 16A schematically depicts a top shaft cross-sectional view and side view of another hockey goalie stick, according to one or more aspects described herein.
Figure 16B:
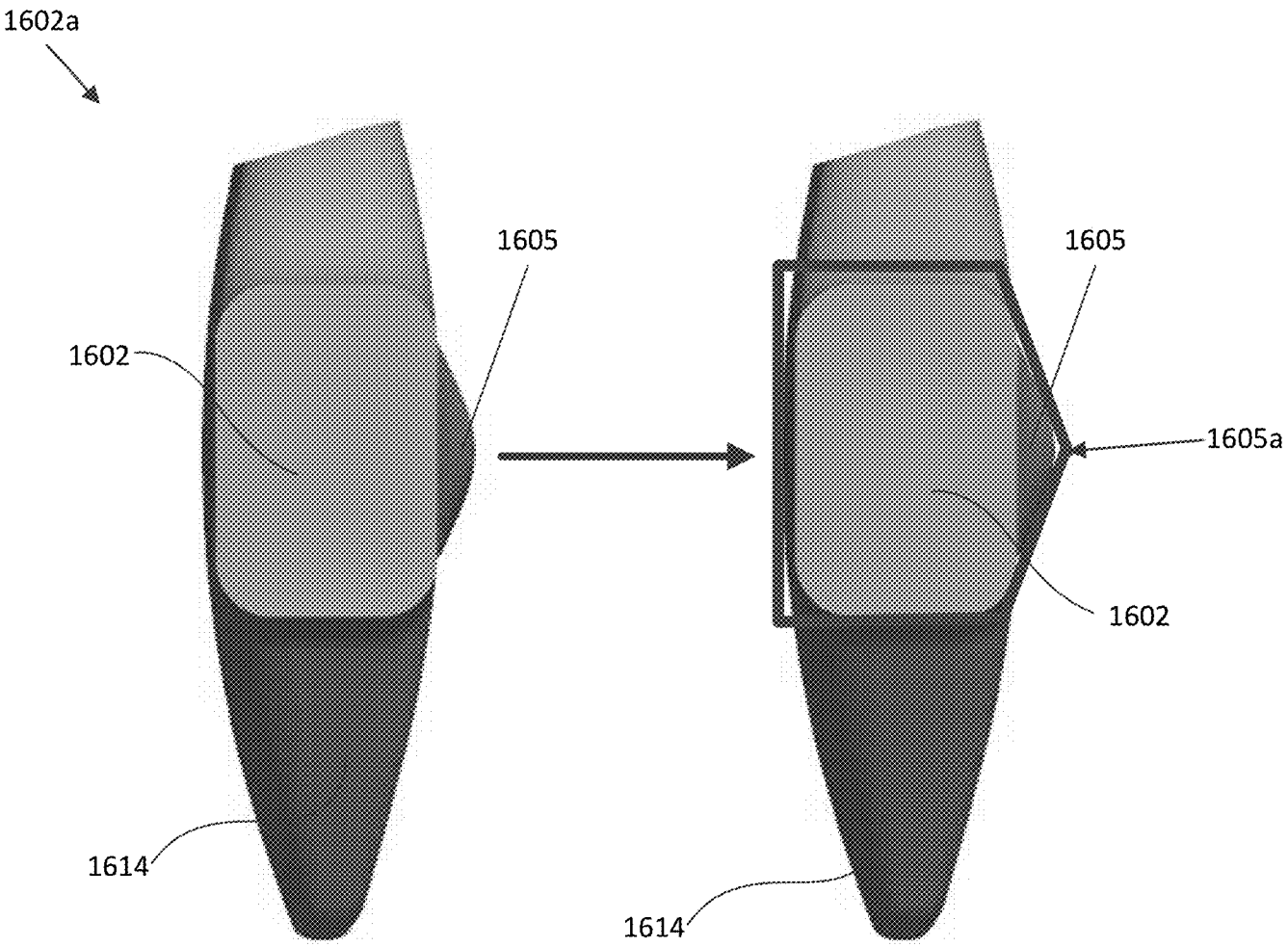
FIG. 16B schematically depicts exploded cross-sectional views of the hockey stick shaft of FIG. 16A with the respective pentagonal geometry cross-section highlighted, according to one or more aspects described herein.

FIG. 16A depicts a top shaft cross-sectional view and side view of a final configuration of another hockey goalie stick 1600. Hockey stick 1600 includes the geometrically variable shaft 1602 and gripping structure 1605, paddle 1614, and blade 1612. An exploded cross-sectional view of the shaft and gripping structure 1602*a* is shown in FIG. 16B. The shaft 1602 and the gripping structure 1605 form a substantially pentagonal-shaped shaft cross-section as highlighted by outline 1605*a*. Again, it is contemplated that the overall shape of the shaft is not limited, and may include other polygonal geometries.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

The invention claimed is:

1. A hockey goalie stick comprising:

a shaft;

a paddle comprising a front face attached to the shaft;

a curved blade comprising a concave side and a convex side attached to the paddle; and a first gripping structure, wherein the first gripping structure is positioned on a front face of the paddle and extends from the shaft into the paddle, wherein the front face of the paddle is on the same side as the concave side of the curved blade, wherein a portion of the first gripping structure that extends into the paddle is convex, and wherein the first gripping structure and the shaft form a five-sided polygonal cross-section, and wherein an apex of the five-sided polygonal cross-section is positioned on the same side as the concave side of the curved blade and the front face of the paddle.

2. The hockey goalie stick of claim 1, wherein the cross-section of the first gripping structure and the shaft is pentagonal-shaped.

3. The hockey goalie stick of claim 1, wherein the first gripping structure extends longitudinally from a midpoint of the shaft towards a top of the shaft.

4. The hockey goalie stick of claim 1, wherein the paddle further includes a second gripping structure positioned opposite the first gripping structure.

5. The hockey goalie stick of claim 4, wherein the second gripping structure is at least one finger or thumb support.

6. The hockey goalie stick of claim 5, wherein the second gripping structure is a plurality of finger or thumb supports.

7. The hockey goalie stick of claim 1, wherein the formed blade, shaft, and paddle are overmolded with the first gripping structure.

8. The hockey goalie stick of claim 1, wherein the blade, the shaft, the paddle, and the first gripping structure are formed together in a first mold.

9. The hockey goalie stick of claim 1, wherein the first gripping structure is attached to the shaft and the paddle with an adhesive.

10. A hockey goalie stick comprising:

a shaft;

a paddle having a paddle front face attached to the shaft;

a curved blade having a blade front face attached to the paddle, wherein the blade front face is a concave side of the curved blade, and wherein the paddle front face and the blade front face are on a same side of the stick;

a gripping structure, wherein the gripping structure is positioned on the shaft and extends into the paddle front face, wherein a portion of the gripping structure that extends into the paddle is convex, and wherein the gripping structure and the shaft form a five-sided polygonal cross-section, and wherein an apex of the five-sided polygonal cross-section is positioned on the same side as the concave side of the curved blade face.

* * * * *